US006263312B1

(12) United States Patent
Kolesnik et al.

(10) Patent No.: US 6,263,312 B1
(45) Date of Patent: Jul. 17, 2001

(54) AUDIO COMPRESSION AND DECOMPRESSION EMPLOYING SUBBAND DECOMPOSITION OF RESIDUAL SIGNAL AND DISTORTION REDUCTION

(75) Inventors: Victor D. Kolesnik; Irina E. Bocharova; Boris D. Kudryashov; Eugene Ovsyannikov; Andrei N. Trofimov; Boris Troyanovsky, all of St. Petersburg (RU)

(73) Assignees: Alaris, Inc., Fremont; G. T. Technology, Inc., Saratoga, both of CA (US)

( * ) Notice: Subject to any disclaimer, the term of this patent is extended or adjusted under 35 U.S.C. 154(b) by 0 days.

(21) Appl. No.: 09/033,431

(22) Filed: Mar. 2, 1998

Related U.S. Application Data

(60) Provisional application No. 60/061,260, filed on Oct. 3, 1997.

(51) Int. Cl.[7] ..... G10L 21/04

(52) U.S. Cl. ..... 704/500; 704/230; 704/229

(58) Field of Search ..... 704/500, 229, 704/501, 502, 503, 504, 200, 201, 205, 206, 212, 222, 268, 269, 227, 230

(56) References Cited

U.S. PATENT DOCUMENTS

| | | | | |
|---|---|---|---|---|
| 5,451,954 | | 9/1995 | Davis et al. | 341/200 |
| 5,602,961 | * | 2/1997 | Kolesnik et al. | 395/2.32 |
| 5,627,938 | | 5/1997 | Johnston | 395/2.39 |
| 5,632,003 | | 5/1997 | Davidson et al. | 395/2.38 |
| 5,634,082 | | 5/1997 | Shimoyoshi et al. | 395/2.38 |
| 5,659,659 | * | 8/1997 | Kolesnik et al. | 704/219 |
| 5,661,822 | * | 8/1997 | Knowles et al. | 382/233 |
| 5,819,215 | * | 10/1998 | Dobson et al. | 704/230 |
| 5,832,443 | * | 11/1999 | Kolesnik et al. | 704/500 |
| 5,845,243 | * | 12/1998 | Smart et al. | 704/230 |
| 5,896,176 | * | 4/1999 | Das et al. | 348/416 |
| 5,909,518 | * | 6/1999 | Chui | 382/277 |

OTHER PUBLICATIONS

Boland and Deriche, "New Results In Low Bitrate Audio Coding Using a Combined Harmonic–Wavelet Representation," 1997 IEEE Int'l Conf on Acoustics, Speech and Signal Processing, pp. 351–354 (Apr. 1997).

(List continued on next page.)

*Primary Examiner*—Richemond Dorvil
(74) *Attorney, Agent, or Firm*—Blakely, Sokoloff, Taylor & Zafman LLP

(57) ABSTRACT

A method and apparatus to achieve relatively high quality audio data compression/decompression, while achieving relatively low bit rates (e.g., high compression ratios). According to one aspect of the invention, a residual signal is subband decomposed and adaptively quantized and encoded to capture frequency information that may provide higher quality compression and decompression relative to transform encoding techniques. According to a second aspect of the invention, an input audio signal is compared to an encoded signal based on the input audio signal to detect and reduce, as necessary, distortion in the encoded signal or portions thereof.

63 Claims, 12 Drawing Sheets

OTHER PUBLICATIONS

K. Brandenburg, et al. , *"ASPEC: Adaptive Special Entropy Coding of High Qulaity Music Signals"*, AES Preprint 301, $90^{th}$ Convention, Paris, Feb. 1991.

K. Tsutsui et al., *"ATRAC: Adaptive Transform Acoustic Coding For Minidisc"*, AES Preprint 3456, $93^{rd}$ Conv. Audio Eng. Soc., Oct. 1992.

K. Brandenburg, G. Stoll: *"The ISO/MEG—Audio Codes: A Generic Standard for Coding of High Quality Digital Audio"*, AES Preprint 3336, $92^{th}$ Convention, Vienna, Mar. 1992.

M.W. Marcellin, T.R. Fisher, *"Trellis Coded Quantization of Memoryless and Gauss–Markov Sources"*, IEEE Transactions of Communications, vol. 38, No. 1, Jan. 1990.

T. Berger, *"Optimum Quantizers and Permutation Codes"*, IEEE Transactions Information Theory, vol. IT–18, No. 6, Nov. 1972.

International Conference on Acoustis, Speech , and Signal Processing. ICASSP–97. Boland et al., :New results in low bitrate audio coding using a combined harmonic–wavelet representaion. vol. I, pp. 351–354, Apr. 1997.*

* cited by examiner

AUDIO ENCODER 730

AUDIO DECODER 1100

AUDIO COMPRESSION AND DECOMPRESSION EMPLOYING SUBBAND DECOMPOSITION OF RESIDUAL SIGNAL AND DISTORTION REDUCTION

This application claims the benefit of U.S. Provisional Application No. 60/061,260, filed Oct. 3, 1997.

BACKGROUND OF THE INVENTION

1. Field of the Invention

The invention relates to the field of signal processing. More specifically, the invention relates to the field of audio data compression and decompression utilizing subband decomposition (audio is used herein to refer to one or more types of sound such as speech, music, etc.).

2. Background Information

To allow typical signal/data processing devices to process (e.g., store, transmit, etc.) audio signals efficiently, various techniques have been developed to reduce or compress the amount of data required to represent an audio signal. In applications wherein real-time processing is desirable (e.g., telephone conferencing over a computer network, digital (wireless) communications, multimedia over a communications medium, etc.), such compression techniques may be an important consideration, given limited processing bandwidth and storage resources.

In typical audio compression systems, the following steps are generally performed: (1) a segment or frame of an audio signal is transformed into a frequency domain; (2) the transform coefficients representing the frequency domain, or a portion thereof, are quantized into discrete values; and (3) the quantized values are converted (or coded) into a binary format. The encoded/compressed data can be output, stored, transmitted, and/or decoded/decompressed.

To achieve relatively high compression/low bit rates (e.g., 8 to 16 kbps) for various types of audio signals some compression techniques (e.g., CELP. ADPCM, etc.) limit the number of components in a segment (or frame) of an audio signal which is to be compressed. Unfortunately, such techniques typically do not take into account relatively substantial components of an audio signal. Thus, such techniques typically result in a relatively poor quality synthesized audio signal due to the loss of information.

One method of audio compression that allows relatively high quality compression/decompression involves transform coding. Transform coding typically involves transforming a frame of an input audio signal into a set of transform coefficients, using a transform, such discrete cosine transform (DCT), modified discrete cosine transform (MDCT), Fourier and Fast Fourier Transform (FFT). etc. Next, a subset of the set of transform coefficients, which typically represents most of the energy of the input audio signal (e.g., over 90%), is quantized and encoded using any number of well-known coding techniques. Transform compression techniques, such as DCT, generally provide a relatively high quality synthesized signal, since a relatively high number of spectral components of an input audio signal are taken into consideration.

Past transform audio compression techniques may have some limitations. First, transform techniques typically perform a relatively large amount of computation, and may also use relatively high bit rates (e.g., 32 kbps), which may adversely affect compression ratios. Second, while the selected subset of coefficients may accumulatively contain approximately 90% of the energy of an input audio signal, the discarded coefficients may be needed for relatively high quality reproduction. However, a substantial amount of bits may be required to transform encode all of the coefficients representing a frame of the input audio signal. Finally, an audible "echo" or other type of distortion may result in an audio signal that is synthesized from transform coding techniques. One cause of echo is the limitations of transform coding techniques to approximate satisfactorily a fast-varying signal (e.g., a drum "attack"). As a result, quantization error for one or a few transform coefficients may spread over and adversely affect an entire frame, or portion thereof, of a transform encoded audio signal.

To illustrate distortion, such as echo, in a transform encoded synthesized signal, reference is made to FIGS. 1A and 1B. FIG. 1A a graphical representation of a frame of an input (i.e., original/unprocessed) audio signal. FIG. 1B depicts a synthesized signal that generated by transform encoding and synthesizing the input signal of FIG. 1A. In FIGS. 1A and 1B, the horizontal (x) axis represents time, while the vertical (y) axis represents amplitude. As shown, the synthesized signal contains relatively substantial distortion (e.g., echo) from the time period 0 to 175 (sometimes referred to as pre-echo, since the distortion precedes the signal (or harmonic) "attack" at time=~175) and 375 to 475 (sometimes referred to as post-echo, since the distortion follows the signal "attack" at time=~175), relative to the corresponding input signal of FIG. 1A.

While some past systems, such as ISO/MPEG audio codes, have employed techniques to diminish distortion due to transform coding, such as pre-echo, such techniques typically rely on an increased number of bits to encode the input signal. As such, compression ratios may be diminished as a result of past distortion reduction techniques.

Thus, what is desired is a system that achieves relatively high quality audio data compression, while achieving relatively low bit rates (e.g., high compression ratios). It is further desirable to detect and reduce distortion (e.g., noise, echo, etc.) that may result, for example, by generating a transform encoded synthesized signal, while providing a relatively low bit rate.

SUMMARY OF THE INVENTION

The present invention provides a method and apparatus to achieve relatively high quality audio data compression/decompression, while achieving relatively low bit rates (e.g., high compression ratios). According to one aspect of the invention, a residual signal is subband decomposed and adaptively quantized and encoded to capture frequency information that may provide higher quality compression and decompression relative to transform encoding techniques. According to a second aspect of the invention, an input audio signal is compared to an encoded version of that input audio signal to detect and reduce, as necessary, distortion in the encoded signal or portions thereof.

DETAILED DESCRIPTION

Figure 1A:
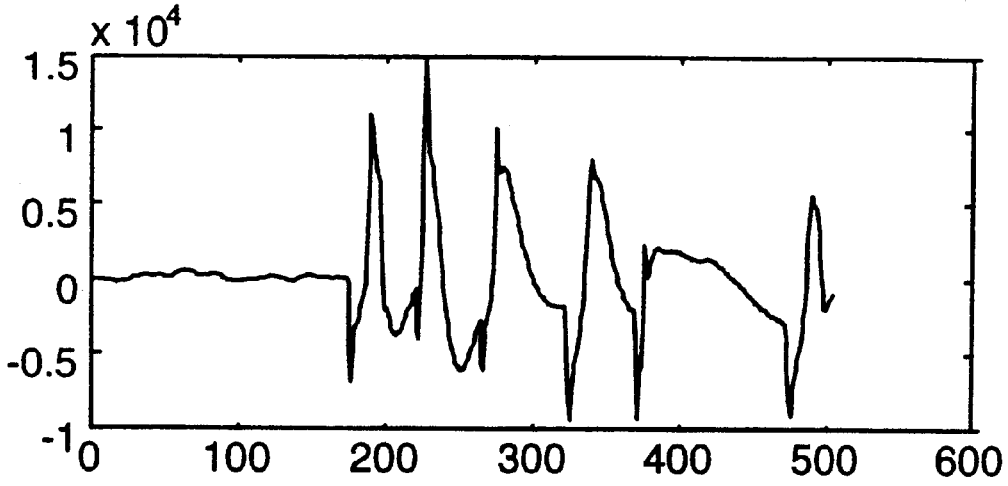
FIG. 1A a graphical representation of an input (i.e., original/unprocessed) audio signal.

A method and apparatus for the compression and decompression of audio signals (audio is used heretofore to refer to various types of sound, such as music, speech, background noise, etc.) is described that achieves a relatively low compression bit rate of audio data while providing a relatively high quality synthesized (decompressed) audio signal. In the following description, numerous specific details are set forth to provide a thorough understanding of the invention. However, it is understood that the invention may be practiced without these details. In other instances, well-known circuits, structures, timing, and techniques have not been shown in detail in order not to obscure the invention.

OVERVIEW

It was found that performing a transform on an input audio signal places most of the energy of "harmonic signals" (e.g., piano) in only a selected number of the resulting transform coefficients (in one embodiment, roughly 20% of the coefficients) because harmonic type sound signals are approximated well by sinusoids. Based on this principle, compression of the harmonic part of an audio signal can be achieved by encoding only the selected number of coefficients containing most of the energy of the input audio signal. However, non-harmonic type sound signals (e.g., drums, laughter of a child, etc.) are not approximated well by sinusoids, and therefore, transform coding of non-harmonic signals does not result in concentrating most of the energy of the signal in a small number of the transform coefficients. As a result, allowing for good reproduction of the non-harmonic parts of an input audio signal requires significantly more transform coefficients (e.g., 90%) be encoded. Hence, the use of transform coding requires a trade off between a higher compression ratio with poor reproduction of non-harmonic signals, or a lower compression ratio with a better reproduction of non-harmonic signals.

In one embodiment of the invention, the input audio signal is split into two parts, a high-energy harmonic part and a low-energy non-harmonic part, that are encoded separately. In particular, the input audio signal is transform encoded by performing one or more transforms (e.g., Fast Fourier Transform (FFT)) and coding only those transform coefficients containing the high-energy harmonic part of the signal. To isolate the lost non-harmonic part of the input audio signal, the following is performed: 1) a synthesized signal is generated from the transform coefficients that were encoded; and 2) a "residual signal" is generated by subtracting the synthesized signal and the input audio signal. Thus, the residual signal represents the data lost when performing the transform coding. The residual signal is then compressed using an approximation in the time domain, because non-harmonic signals are approximated better in the time domain than in the frequency domain. For example, in one embodiment of the invention the residual signal is subband decomposed and adaptively quantized. During the adaptive quantization, more emphasis (the allocation of a relatively greater number of bits) is placed on the higher frequency subbands because: 1) the transform coding allows relative high quality compression of the lower frequencies; and 2) distortions generated by transform coding on low frequencies are masked (in most cases) by high-energy low-frequency harmonics.

In addition to not being approximated well by sinusoids, non-harmonic parts of an input audio signal also result in distortion (e.g., the previously described audible echo effect). In another embodiment of the invention, this distortion is adaptively compensated/reduced by suppressing the distortion in the synthesized signal. In particular, the synthesized signal and the input audio signal are subband decomposed, and the resulting subbands are compared in an effort to locate distortion. Then, an effort is made to suppress the distortion in the synthesized signal subbands, thereby generating a set of distortion-reduced synthesized signal subbands. The difference between the input audio signal subbands and the distortion reduced synthesized signal subbands is then determined to generate a set of residual signal subbands which are adaptively quantized and coded. The transform encoded data and the subband encoded data, as well as any other parameters (e.g., distortion reduction parameters), are multiplexed and output, stored, etc., as compressed audio data.

In one embodiment of the invention that performs decompression, compressed audio data is received in a bit stream. An audio signal is reconstructed by performing inverse transform coding and subband reconstruction on the encoded audio data contained in the bit stream. In one embodiment, distortion reduction may also be performed.

COMPRESSION

Figure 2:
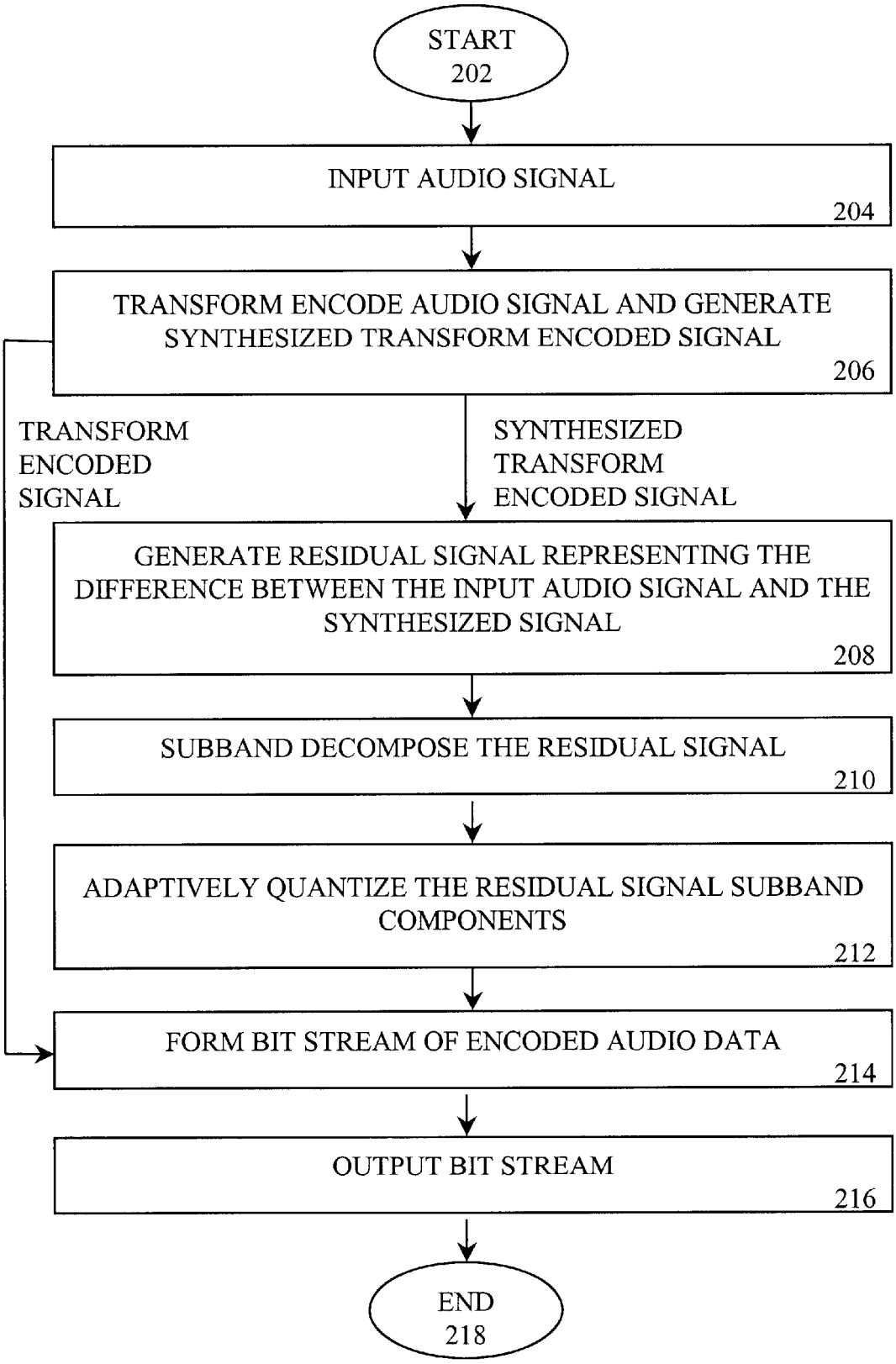
FIG. 2 is a flow diagram illustrating a method for audio compression utilizing subband decomposition of a residual signal, according to one embodiment of the invention.
Figure 3:
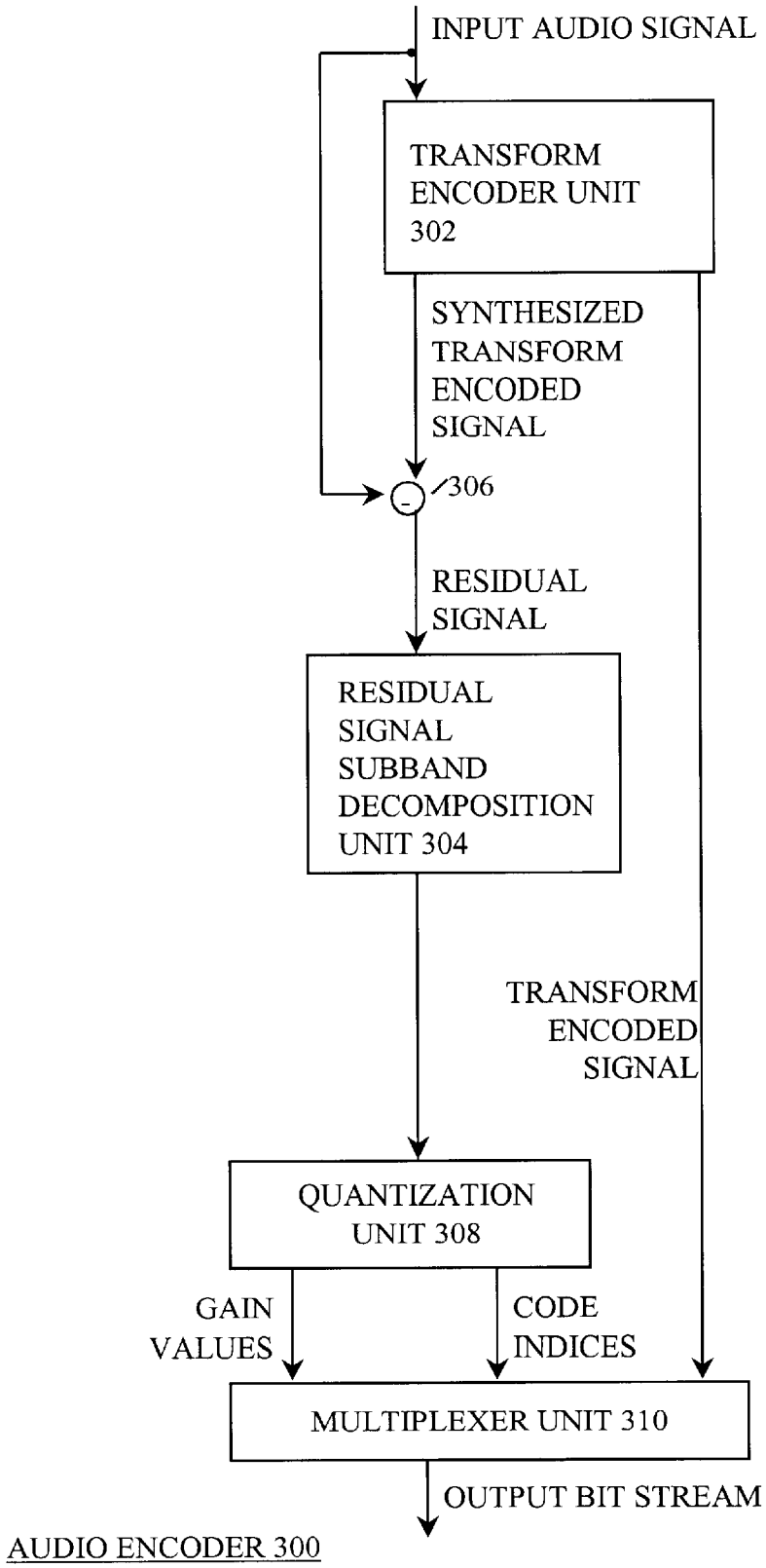
FIG. 3 is a block diagram of an audio encoder employing subband decomposition of a residual signal, according to one embodiment of the invention.

An Embodiment of the Invention Utilizing Subband Decomposition of a Residual Signal FIG. 2 is a flow diagram illustrating a method for audio compression utilizing subband decomposition of a residual signal according to one embodiment of the invention, while FIG. 3 is a block diagram of an audio encoder employing subband decomposition of a residual signal according to one embodiment of the invention. To ease understanding of the invention, FIGS. 2 and 3 will be described together. In FIG. 2, flow begins at step 202 and ends at step 218. From step 202, flow passes to step 204.

At step 204, an input audio signal is received, and flow passes to step 206. The input audio signal may be in analog or digital format, or may be transformed from one format to another. Furthermore, in one embodiment of the invention a sample rate of 8 to 16 khps is used and the input audio signal is partitioned into overlapping frames (sometimes referred to as windows or segments). In alternative embodiments, the input audio signal may be partitioned into non-overlapping frames. The input audio signal may also be filtered.

At step 206, a frame of the input audio signal is transform coded to generate a transform coded audio signal, and the transform coded audio signal is reconstructed to generate a synthesized transform encoded signal. The transform coded audio signal eventually becomes part of the bit stream in step 214, while the synthesized transform coded signal is provided to step 208. In one embodiment, a Fast Fourier Transform (FFT) is used to transform the frame of the input audio signal into a set of coefficients. In alternative embodiments, other types of transform techniques may be used (e.g., DCT, FT, MDCT, etc.). In one embodiment, only a subset of the set of coefficients are selected to encode the input audio signal (e.g., ones that approximate the most substantial spectral components), while in alternative embodiments, all of the set of coefficients are selected to encode the input audio signal. In one embodiment, the selected transform coefficients are quantized and encoded using combinatorial encoding (see V. F. Babkin, *A Universal Encoding Method with Nonexponential Work Expenditure for a Source of Independent Message*, Translated from Problemy Peredachi Informatsii, Vol. 7, No. 4, pp. 13–21, October–December 1971, pp. 288–294 incorporated by reference; and "A Method and Apparatus for Adaptive Audio Compression and Decompression", Application Ser. No. 08/806,075, filed Feb. 25, 1997, incorporated by reference) to generate encoded quantized transform coefficients that represent the transform coded audio signal.

Correlating step 206 to FIG. 3, an audio encoder 300 is shown which includes a transform encoder and synthesizer unit 302. Although the transform encoder and synthesizer unit 302 is shown coupled to receive the input audio signal, it should be appreciated that the input audio signal may be received and processed by additional logic units (not shown) prior to being provided to the transform encoder and synthesizer unit 302. For example, the input audio signal may be filtered, modulated, converted between digital-analog formats, etc., prior to transform encoding. The transform encoder and synthesizer unit 302 is provided the input audio signal to generate the transform coded audio signal (sometimes referred to as transform encoded data) and to generate the synthesized transform encoded audio signal. The transform coded audio signal is provided to a multiplexer unit 310 for incorporation into the bit stream, while the synthesized signal is provided to a subtraction unit 306.

At step 208, a residual signal is obtained by determining a difference between the input audio signal and the synthesized transform encoded signal, and flow passes to step 210. Correlating step 208 to FIG. 3, the subtraction unit 306 determines a difference between the synthesized transform encoded signal and the input audio signal itself, which difference is the residual signal.

At step 210, the residual signal is decomposed into a set of subbands, and flow passes to step 212. While in certain embodiments, the residual signal is decomposed and processed (e.g., approximated) in the time domain, in other embodiments the residual signal is generated, decomposed, processed, etc., in the transform/frequency domain.

In one embodiment, a wavelet subband filter is employed to perform one or more wavelet decompositions of the residual signal to generate the set of subbands. For example, in one embodiment of the invention, the residual signal is decomposed into a high frequency subband (H) and a low frequency subband (L), and then the low frequency subband (L) is further decomposed into a low-high frequency portion (LH) and a low-low frequency portion (LL). Generally, the LL subband contains most of the signal energy, while the HH subband represents a relatively small percentage of the energy. However, since the transform coefficients that are encoded provide relatively high quality approximation of the low frequency portions of the input audio signal, the high frequency portions of the residual signal (e.g., H and LH) may be allocated most or all of the processing, quantization bits, etc. For example, in one embodiment of the invention the H and LH subbands are allocated roughly ½ bits per sample for quantization, while the LL subband is allocated roughly ¼–⅓ bits per sample.

While one embodiment is described in which the residual signal is decomposed into three subbands, alternative embodiments can decompose the input audio signal any number of ways. For example, if even greater granularity is desired, in an alternative embodiment, the high frequency subband (H) may be further decomposed into a high-high frequency portion (HH) and a high-low frequency portion (HL), as well. As such, the greatest amount of processing/quantization bits may be allocated to HH, while fewer bits may be allocated to HL, and even fewer to LH, and the fewest to LL. For example, in one embodiment, no bits are allocated to LL, since the previously described transform coding may provide satisfactory encoding of the lower frequency portions of an input audio signal with relatively little distortion.

With reference to FIG. 3, the residual signal generated by the subtraction unit 306 is coupled to a residual signal subband decomposition unit 304. An exemplary technique for performing the wavelet decompositions is described in more detail later herein with reference to FIG. 4.

At step 212, the subband components are adaptively quantized, and flow passes to step 214. With reference to FIG. 3, the subband information for the residual signal is provided to a trellis quantization unit 308. The trellis quantization unit 308 performs an adaptive quantization of the subband information for the residual signal to generate a set of codeword indices and gain values. The codeword indices and the gain values are provided to the multiplexer unit 310. While one embodiment is described in which an adaptive trellis quantization (described in greater detail below with reference to FIG. 5) is used, alternative embodiments can use other types of coding techniques (e.g., Huffman/variable length coding, etc.).

At step 214, the encoded subband components and transform coefficients, and any other information/parameters, are multiplexed into a bit stream, and flow passes to step 216. With reference to FIG. 3, the multiplexer unit 310 multiplexes the encoded quantized transform coefficients, the codeword indices, and the gain values into a bit stream of encoded/compressed audio data. It should be understood that the bit stream may contain additional information in alternative embodiments of the invention.

At step 216, the bit stream including the encoded audio data is output (e.g., stored, transmitted, etc.), and flow passes to step 218, where flow ends.

Subband (e.g., Wavelet) Decomposition According to One Embodiment of the Invention As described above with reference to step 210, subband decomposition of a residual signal, which in one embodiment represents the difference between a synthesized (e.g., transform encoded) signal and the input audio signal, may be performed in one or more embodiments of the invention. By performing subband decomposition of a residual signal, the invention may provide improved quality over techniques that only employ transform coding, especially with respect to non-harmonic signals found in the high frequency and/or low energy components of an audio signal. Furthermore, subband filters, such as wavelet filters, may provide relatively efficient hardware and/or software implementations.

Figure 4:
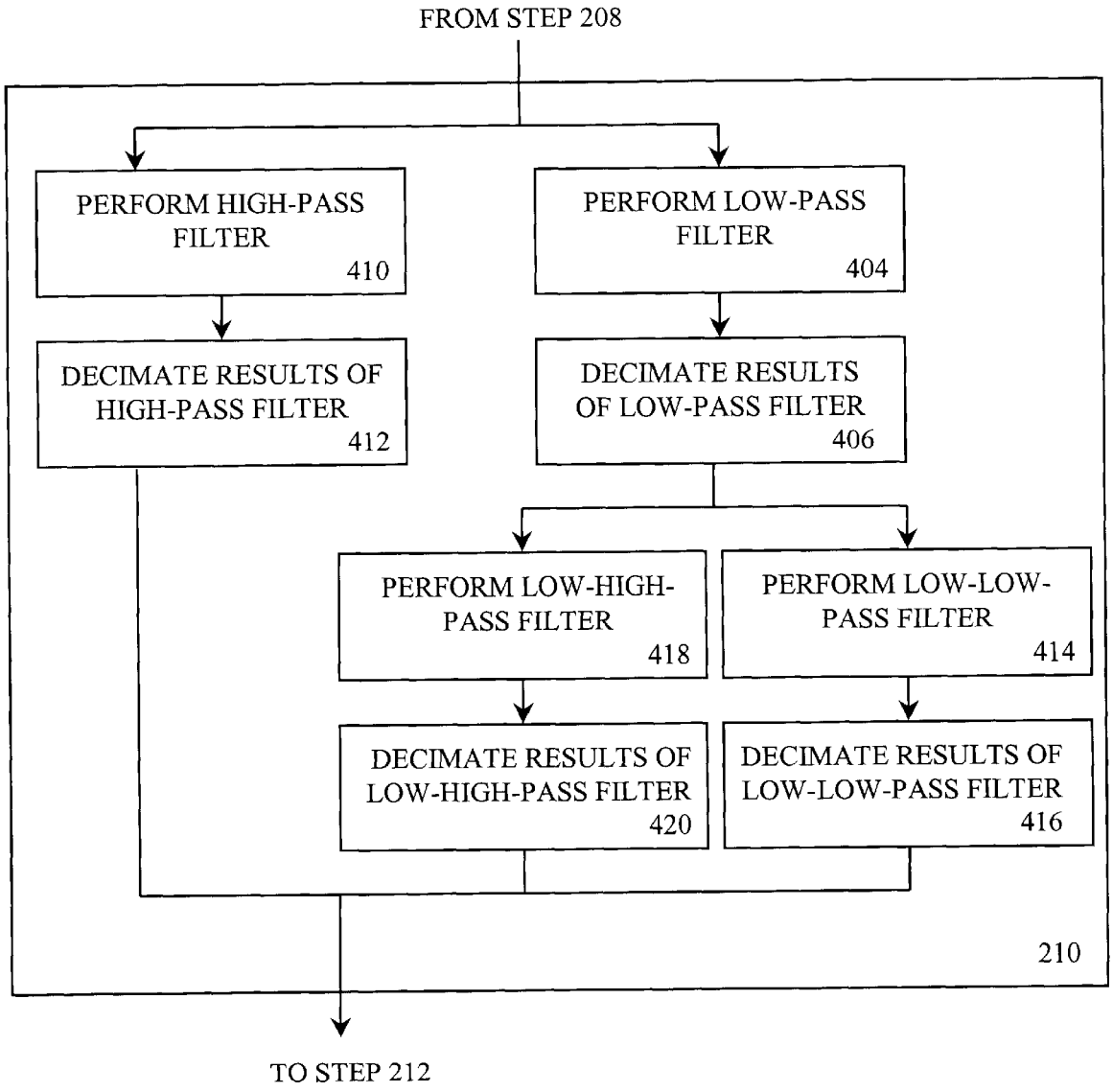
FIG. 4 is a flow diagram illustrating the subband filtering of a residual signal that may be performed in step 210 according to one embodiment of the invention.

FIG. 4 is a flow diagram illustrating subband filtering of a residual signal that may be performed in step 210 according to one embodiment of the invention. As shown in FIG. 4, the residual signal is received from step 208. In one embodiment, in which the residual signal has N samples, the N samples of the residual signal are input into a cyclic buffer and a cyclic extension method is used. In alternative embodiments, other types of storage devices and/or methods may be used. For a description of other exemplary methods (e.g., mirror extension), see G. Strand & T. Nguen, *Wavelets and Filter Banks*, Wallesley-Cambridge (1996).

In steps 404 and 410, a low-pass filter (LPF) and a high-pass filter (HPF) are respectively performed on the residual signal. In one embodiment, finite impulse response (FIR) filters are implemented in the LPF and HPF to filter the residual signal. In alternative embodiments, other types of filters may be used. In one embodiment, the LPF and HPF are implemented by biorthogonal quadrature filters having the following coefficients:

$$\mathrm{LPF}=\sqrt{2}(-1/8,\ 1/4,\ 3/4,\ 1/4,\ -1/8)$$

$$\mathrm{HPF}=\sqrt{2}(-1/4,\ 1/2,\ -1/4)$$

The output sequences of the LPF and the HPF, having length N each, are respectively decimated in steps 406 and 412 to select N/2 coefficients of the low frequency subband (L) and of the high frequency subband (H), respectively.

In one embodiment, the N/2 low frequency subband information is stored in a buffer (which may be implemented as a cyclic buffer). In steps 414 and 418, a low-low-pass filter (LLPF) and a low-high-pass filter (LHPF) are respectively performed on the results of step 406 (the low frequency subband (L)). In one embodiment, the LLPF and LHPF are implemented by biorthogonal quadrature filters having the following coefficient(s):

$$\mathrm{LLPF}=\sqrt{2}(-1/8,\ 1/4,\ 3/4,\ 1/4,\ -1/8)$$

$$\mathrm{LHPF}=\sqrt{2}(-1/4,\ 1/2,\ -1/4)$$

The output sequences of the LLPF and the HPF, having length N/2 each, are respectively decimated in steps 416 and 420 to select N/4 samples of the low-low frequency subband (LL) and the low-high frequency subband (LH), respectively.

While one embodiment has been described wherein the residual signal is subjected to a high-pass, a low pass, a low-low pass, and a low-high pass, subband filter, alternative embodiments may perform any number of subband filters upon the residual signal. For example, in one embodiment, the residual signal is only subjected to a high-pass filtering and a low-pass filtering. Furthermore, it should be appreciated that in alternative embodiments of the invention, the subband filters may have characteristics other than those described above.

Trellis Quantization According to One Embodiment of the Invention

In one embodiment of the invention, the subband information is quantized according to an adaptive quantizer (a unit that selects different code rates (and other parameters) for quantizer(s) dependent on the energies of the subbands generated from subband filtering the residual signal). For a given input, the adaptive quantizer selects a set of quantization trellis codes that provide the best performance (e.g., under some restrictions on bit tital rate). Then, the quantizer (s) each endeavor to select the best one of the different codewords (i.e., the codeword that will provide the most correct approximation of the input).

As described below, the adaptive quantizer of one embodiment of the invention uses a modified Viterbi algorithm to process a trellis code. The trellis code minimizes the amount of data required to indicate which codeword was used, while the modified Viterbi algorithm allows for the selection of the best one of the different codewords without considering every possible codeword. Of course, any number of different quantizers could be used in alternative embodiments of the invention.

Figure 5:
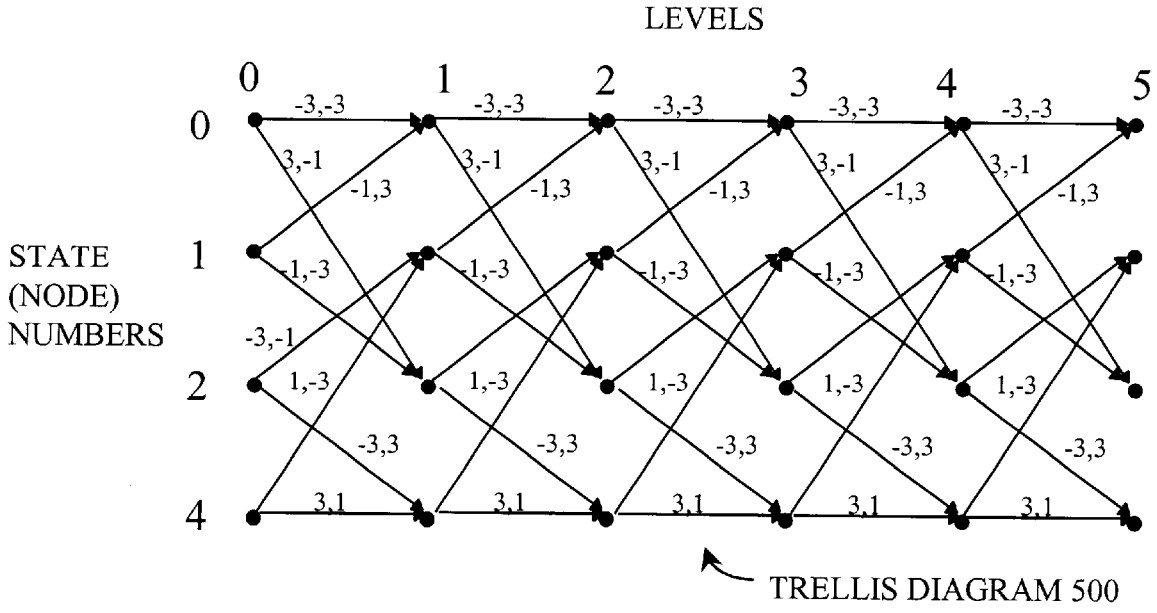
FIG. 5 illustrates a trellis diagram representing a trellis code to quantize subband information, according to one embodiment of the invention.

FIG. 5 illustrates a trellis diagram representing a trellis code to quantize subband information, according to one embodiment of the invention. In FIG. 5, a trellis diagram 500 is shown, which represents a trellis code of length 10. Any path through the trellis diagram 500 defines a code word. The trellis diagram 500 has 6 levels (labeled 0–5), with 4 states (or nodes) per level (labeled 0–3). Each state in the trellis diagram 500 is connected to two other states in the next higher level by two "branches." Since the trellis diagram 500 includes four initial states and there are two branches/paths from any state, the total number of code words in the code depicted by the trellis diagram 500 is $4*2^5$. To encode a code word, two bits are used to indicate the initial state and one bit is used to indicate the branches taken (e.g., the upper and lower branches may be respectively distinguished by a 0 and 1). Therefore, the code word (3, -1, 1, -3, -1, 3, 3, -3, -3, -3) is identified by the binary sequence 0010000. Accordingly, each code word may be addressed by a 7-bit index, and the corresponding code rate is 7/10 bits per sample.

In one embodiment, the code words of one or more trellis quantizers are multiplied by a gain value to minimize a Euclidean distance, since the input sequences may have varying energies. For example, if the input sequences of a trellis quantizer is denoted by y, the code words of the trellis quantizer are denoted by x, the gain value is denoted by g, and the distortion is denoted by d(x,y), then in one embodiment, the following relationship is used:

$$d(x,y)=\|y-gx\|^2$$

The determination of a code word x (the path through the trellis diagram) and a gain value to minimize the distortion d(x,y) is performed, in one embodiment, by maximizing a match function M(x,y), expressed as $$M(x,\ y)=\frac{(x,\ y)^2}{\|x\|^2},$$

wherein (x,y) denotes an inner product of vectors x and y, and $\|x\|^2$ represents the energy or squared norm of the vector x.

Since the total number of code words under consideration is large (in general), an exhaustive search for the best path is computational expensive. As such, one embodiment of the invention uses the previously mentioned modified Viterbi algorithm for maximum likelihood of decoding of trellis codes. The Viterbi algorithm is based on the fact that pairs of branches from previous levels in the trellis diagram merge into single states of the next level. For example, the branches from states 0 and 1 on level 0 merge to state 0 of level 1. As a result, there are pairs of different code words which differ only in the branches from level 0. For example, the code words identified by the binary sequences 0000000 and 0100000 differ only in the initial state. Of course, this holds true for the other levels of the trellis diagram.

Conceptually, the Viterbi algorithm chooses and remembers the best of the two code words for each state and forgets the other. Using the modified Viterbi algorithm, for each level of the trellis diagram 500, the adaptive quantizer maintains for each state of the trellis a best path (also termed "survived path") x and the survived path's maximum match function (both the inner product (x,y) and the energy $\|x\|^2$).

For the zero-level the energies ($\|x\|^2$) and inner products (x,y) are set to zero. Furthermore, from a node of the trellis diagram 500, previous nodes may be inspected to compute energies and inner products of all paths entering the node by summing energies and inner products of correspondent branches to energies and inner products of survived paths. Subsequently, the match function M(x,y) may be computed according to the above expression for competing paths, and the maximal match function may be selected.

In one embodiment, the gain value, g, is computed as follows:

$$g=(x,y)/\|x\|^2.$$

The gain value g may be quantized using a predetermined or adaptive quantization (e.g., the values 0 and 1). In one embodiment, the quantizer outputs an index of a selected code word and an index of a quantized gain value g.

With regard to bit allocations, one embodiment of the invention uses the following bit allocations for two bit rates:

| | | |
|---|---|---|
| Frame Length | 512 samples | 512 samples |
| Number of bits for transform coding | 327 | 748 |
| Code rate for LL subband | 0 | ¼ |
| Number of bits for trellis quantization for LL subband | 0 | 256* ¼ = 64 |
| Code rate for LH subband | ½ | ½ |
| Number of bits for trellis quantization for LH subband | 128* ½ = 64 | 128* ½ = 65 |
| Code rate for H subband | ½ | ½ |
| Number of bits for trellis quantization for H subband | 128* ½ = 64 | 128* ½ = 64 |
| Bits for gains and initial states | 20 | 30 |
| Total number of bits for trellis quantization | 148 | 222 |
| Total number of bits per frame | 475 | 970 |
| Bit rate | 0.93 bit/sample | 1.89 bits/sample |

These two examples provide constant bit rate near 1 and 2 bits per sample. Some bits may be reserved for other purposes (e.g., error protection). In addition, the above example bit allocations do not include bits for distortion detection and reduction (described later herein). While one embodiment using specific bit allocations is described, alternative embodiments could use different bit allocations.

An Alternative Embodiment Employing Distortion Detection and Reduction

Figure 6:
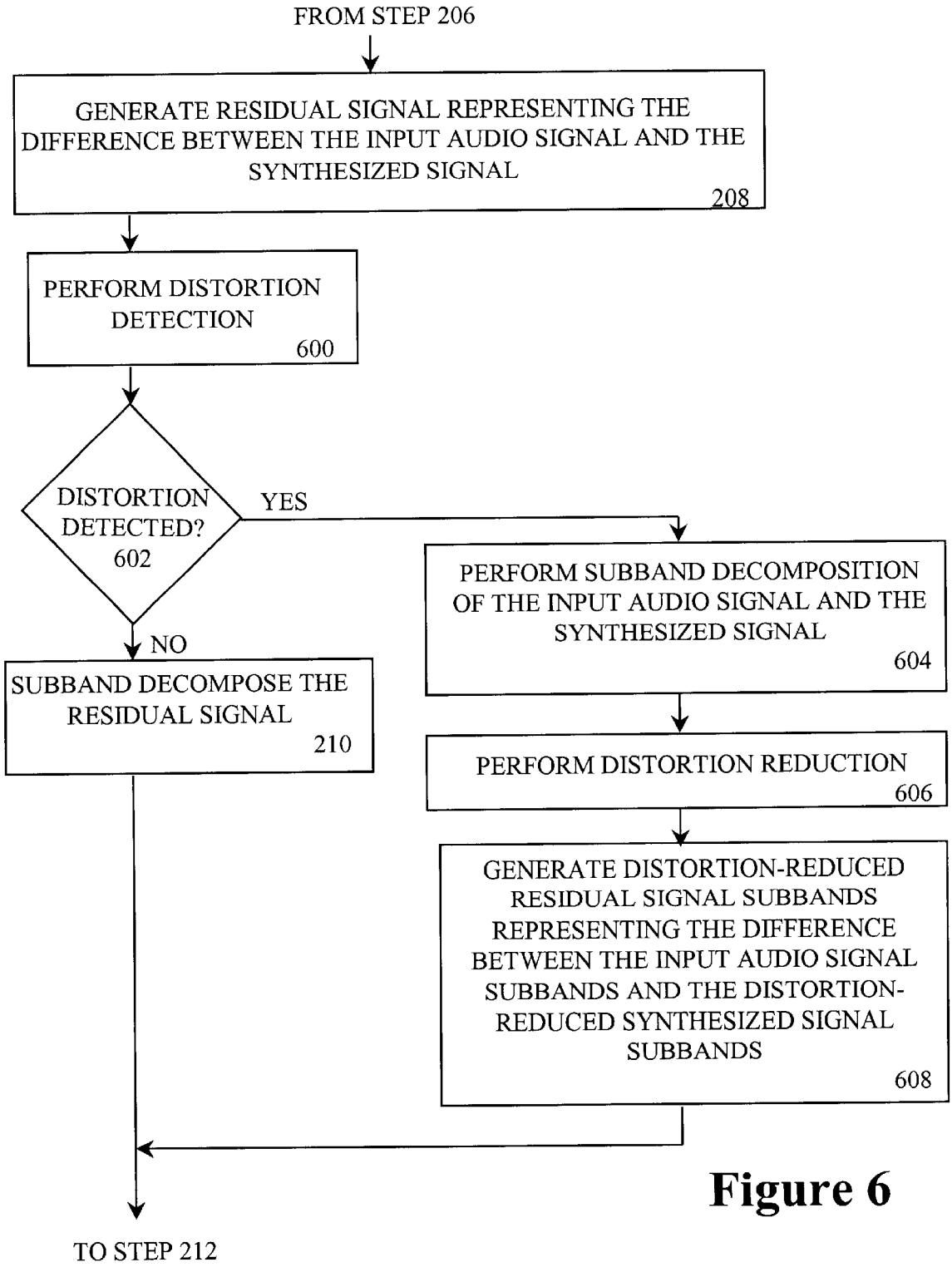
FIG. 6 is a flow diagram illustrating how distortion detection and reduction can be incorporated into the method of FIG. 2 according to one embodiment of the invention.
Figure 7:
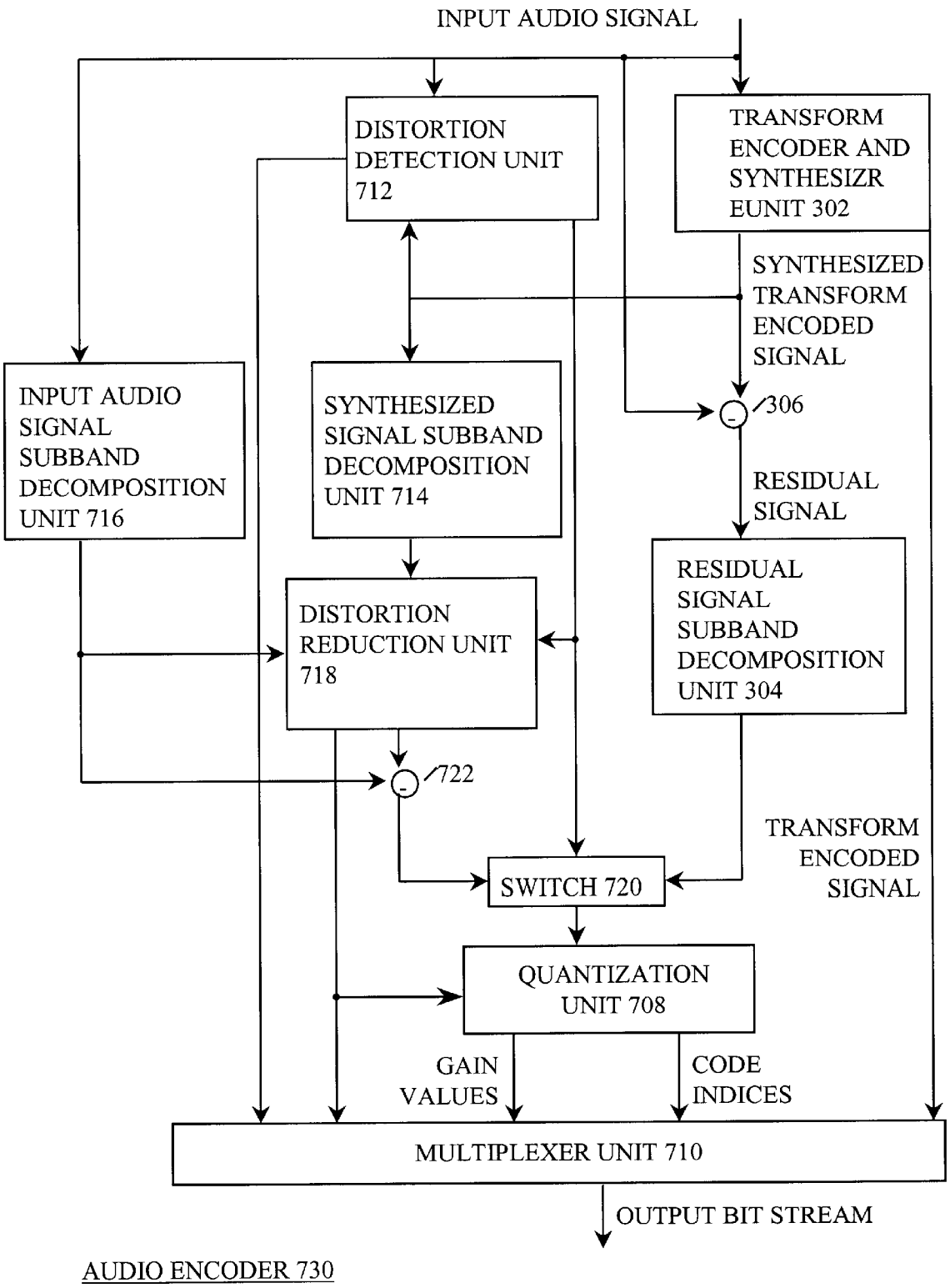
FIG. 7 is a block diagram of an audio encoder employing distortion detection and reduction according to one embodiment of the invention.

FIG. 6 is a flow diagram illustrating how distortion detection and reduction can be incorporated into the method of FIG. 2 according to one embodiment of the invention, while FIG. 7 is a block diagram of an audio encoder employing distortion detection and reduction according to one embodiment of the invention. To ease understanding of the invention, FIGS. 6 and 7 will be described together.

In FIG. 6, flow passes from step 208 to step 600. At step 600, distortion detection is performed, and flow passes to step 602. In one embodiment, a ratio between signal and noise is used to detect distortion. Exemplary techniques for performing step 600 are further described later herein with reference to FIG. 9.

At step 602, if distortion was not detected, flow passes to step 210 of FIG. 2. Otherwise, flow passes to step 604. While in one embodiment of the invention distortion detection is performed, alternative embodiments may not bother detecting distortion, but perform steps 604–608 all the time.

Correlating steps 600 and 602 to FIG. 7, FIG. 7 shows an audio encoder 730 which includes the transform encoder/synthesizer unit 302, the residual signal subband decomposition unit 304 and the subtraction unit 306 of FIG. 3. Unlike the audio encoder 300, the audio encoder 730 can operate in two different modes, a non-distortion reduced subband compression mode and a distortion reduced subband compression mode. To select the appropriate mode of operation, the audio encoder 730 includes a distortion detection unit 312 that is coupled to receive the input audio signal and that is coupled to the transform encoder/synthesizer unit 302 to receive the synthesized signal. In addition, the distortion detection unit 312 is coupled to provide a signal to a switch 720, a distortion reduction unit 718, and a multiplexer unit 710 to control the mode of the audio encoder 730. As described with reference to step 600, the distortion detection unit 712 compares the input audio signal to the synthesized signal to determine if distortion is present based on a predetermined distortion detection parameter.

If the distortion detection unit 312 does not detect distortion, the audio encoder 730 operates the non-distortion reduced subband mode (step 210) which is similar to the operation of the audio encoder 300 described above with reference to FIG. 3. In particular, the transform encoder/synthesizer unit 302, residual signal subband decomposition unit 304, and the subtraction unit 306 are coupled as shown in FIG. 3. In contrast to FIG. 3, the output of the signal subband decomposition unit 304 is coupled to the switch 720, and the output of the switch 720 is provided to the trellis quantization unit 708. The output of the trellis quantization unit 708 and the transform encoded output from the transform encoder/synthesizer unit 302 are provided to the multiplexer unit 710. The trellis quantization unit 708 and the multiplexor unit 710 operate in a similar manner to the trellis quantization unit 308 and the multiplexer unit 310 when the audio encoder 730 is in the non-distortion reduced subband mode.

However, if distortion is detected by the distortion detection unit 312, the audio encoder 730 operates in the distortion reduction mode as described below with reference to steps 604–608.

At step 604, the input audio signal and the synthesized signal are subband decomposed, and flow passes to step 606. In one embodiment, a wavelet filter is utilized to decompose the input audio signal and the synthesized signal into a set of subbands, each. Correlating step 606 to FIG. 7, the synthesized signal and the input audio signal are respectively decomposed into sets of subbands by a synthesized signal subband decomposition unit 714 and an input audio signal subband decomposition unit 716. The output of the unit 714 (i.e., the subband decomposed synthesized signal) and the output of the unit 716 (i.e., the subband decomposed input audio signal) are coupled to a distortion reduction unit 318. While in one embodiment the same subband decomposition technique is used in step 604 that is used in step 210, alternative embodiments can use different subband decomposition techniques.

At step 606, distortion reduction is performed, and flow passes to step 608. Correlating step 606 to FIG. 7, the distortion reduction unit 718 compares the synthesized signal subbands and the input audio signal subbands to suppress distortion when it exceeds a predetermined threshold. The distortion reduction unit 718 generates: 1) a set of distortion-reduced synthesized signal subbands that are provided to a subtraction unit 722; and 2) a set distortion reduction parameters (later described herein) that are provided to the trellis quantization unit 708 and the multiplexer unit 710. Exemplary techniques for performing step 606 are described later herein with reference to FIG. 9.

At step 608, a set of distortion-reduced residual signal subbands representing the difference between the distortion-reduced synthesized signal subbands and the input audio signal subbands are generated, and flow passes to step 212 of FIG. 2. Correlating step 608 to FIG. 7, the subtraction unit 322 receives the distortion-reduced synthesized signal subbands in addition to the input audio signal subbands. The subtraction unit 322 is coupled to the switch 720 to provide the distortion-reduced residual signal subbands.

In summary, when the audio encoder 730 is in the first mode, the distortion detection unit 712 controls the switch 720 to select the output of the residual signal subband decomposition unit 304, while the trellis quantization unit 708 and the multiplexer unit 710 perform the necessary coding and multiplexing as previously described with reference to FIG. 3. In contrast, when the audio encoder 730 is in the second mode: the distortion detection unit 712 controls the switch 720 to select the output of the subtraction unit 722; the trellis quantization unit 708 generates codeword indices and gain values; and the multiplexer unit 710 generates an output bit stream of encoded audio data, which includes information indicating whether the audio encoder performed distortion reduction (provided by the distortion detection unit 312) and distortion reduction parameters (provided by the distortion reduction unit 318). The output bit stream may be transmitted over a data link, stored, etc.

It should be appreciated that one or more of the functional units in FIG. 7 may be utilized in both modes of operation. For example, one subtraction unit may be utilized to obtain a residual signal in the first or second modes.

Distortion Detection According to One Embodiment of the Invention

Figure 8:
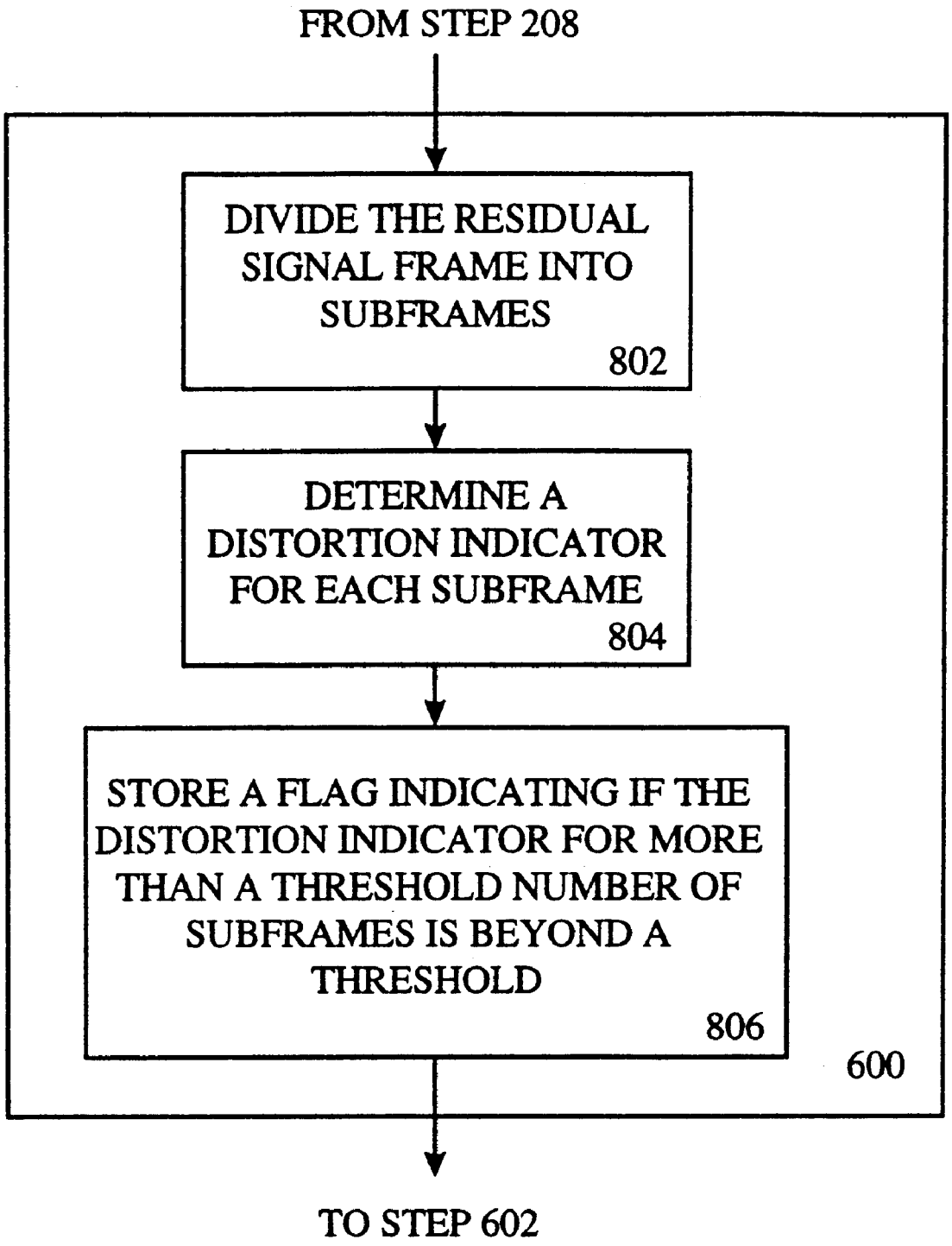
FIG. 8 illustrates an exemplary method for performing distortion detection in step 600 of FIG. 6, according to one embodiment of the invention.

FIG. 8 illustrates an exemplary technique for performing distortion detection at step 600 of FIG. 6 according to one embodiment of the invention. In FIG. 8, flow passes from step 208 of FIG. 6 to step 802.

At step 802, the residual signal frame (representing the difference between the input audio signal frame and the synthesized signal frame) is divided into a set of subframes, and flow passes to step 804. While in one embodiment the residual signal is divided into a set of non-overlapping subframes, alternative embodiments could use different techniques, including overlapping subframes, sliding subframes, etc.

At step 804, a distortion indicator value is determined for each subframe, and flow passes to step 806. Various techniques can be used for generating a distortion indicator. By way of example, the following indicators can be used:

Signal-to-noise ratio (SNR)=$\|x\|^2/\|x-y\|^2$;

Noise-to-signal ratio (NSR)=$\|x-y\|^2/\|x\|^2$;

Energy ratio=$\|x\|^2/\|y\|^2$; or $$\text{Maximal distortion} = \max_i |x_i - y_i|$$

where $x=(x_1, \ldots, x_n)$ is the original signal, $y=(y_1, \ldots, y_n)$ is the synthesized signal, and $\|\ \|$ denotes Euclidean norm (square root of energy). Basically, the distortion being detected is a result of errors in the transform encoding.

At step 806, data is stored indicating whether the distortion indicator for more than a threshold number of subframes is beyond a threshold, and flow passes to step 602. In one embodiment, the distortion indicator value for each subframe is compared to a threshold distortion indicator value, and a distortion flag is stored indicating whether a threshold number of the subframe distortion indicators exceeded the threshold distortion indicator value. In one embodiment wherein signal-to-noise ratio (SNR) is measured in step 804, if the SNR of a subframe is below a threshold SNR value (e.g., a value of 1), then distortion is detected in that subframe. In an alternative embodiment wherein noise-to-signal ratio (NSR) is measured in step 804, if NSR of a subframe is above a threshold NSR value, distortion is detected in that subframe. Thus, it should be understood that depending on the type of distortion indicator used, a distortion indicator value may be above, below, or equal to a corresponding threshold value for distortion to be detected. From step 806, control passes to step 602 where the distortion flag is polled to determine whether distortion reduction mode is to be used.

While FIG. 8 is a flow diagram illustrating the parallel processing of all of the subframes at once, alternative embodiments could iteratively perform the operations of FIG. 8 on subsets of the subframes (e.g., one or more, but less than all of the subframes) in parallel, stopping at the earlier of all the subframes being processed or determining that distortion reduction should be performed. Furthermore, while one exemplary technique has been described for determining whether distortion is detected for a give frame (e.g., dividing into subframes, calculating distortion indicator values, etc.), alternative embodiments can use any number of other techniques.

Distortion Reduction According to One Embodiment of the Invention

Figure 9:
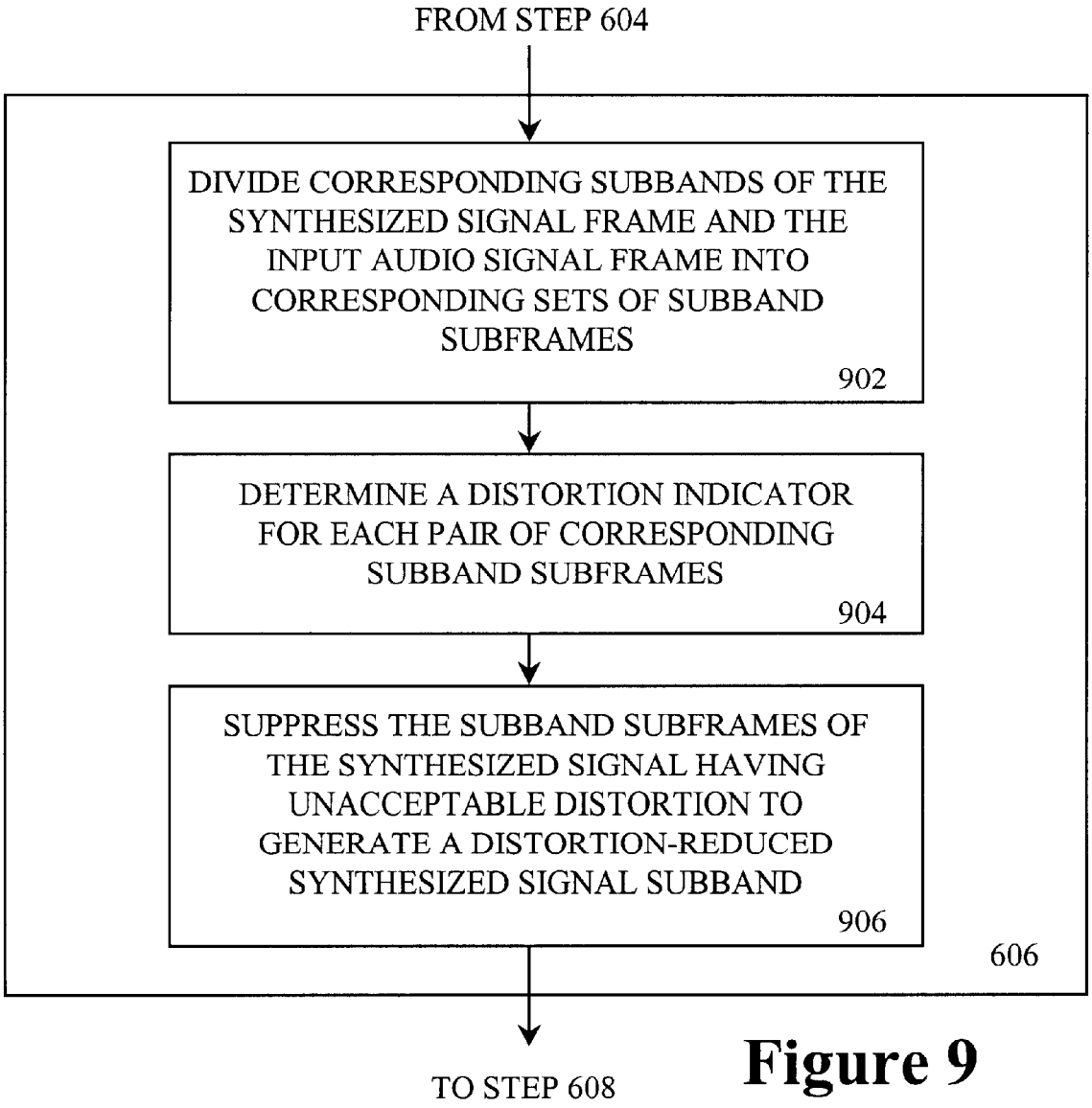
FIG. 9 is a flow diagram illustrating an exemplary method for performing distortion reduction in step 606 of FIG. 6 according to one embodiment of the invention.

FIG. 9 is a flow diagram illustrating an exemplary method for performing distortion reduction in step 606 of FIG. 6 according to one embodiment of the invention. Since the same steps may be performed for all subbands of the synthesized signal, FIG. 9 illustrates the steps for a single subband. In FIG. 9, flow passes from step 604 of FIG. 6 to step 902.

Figure 10:
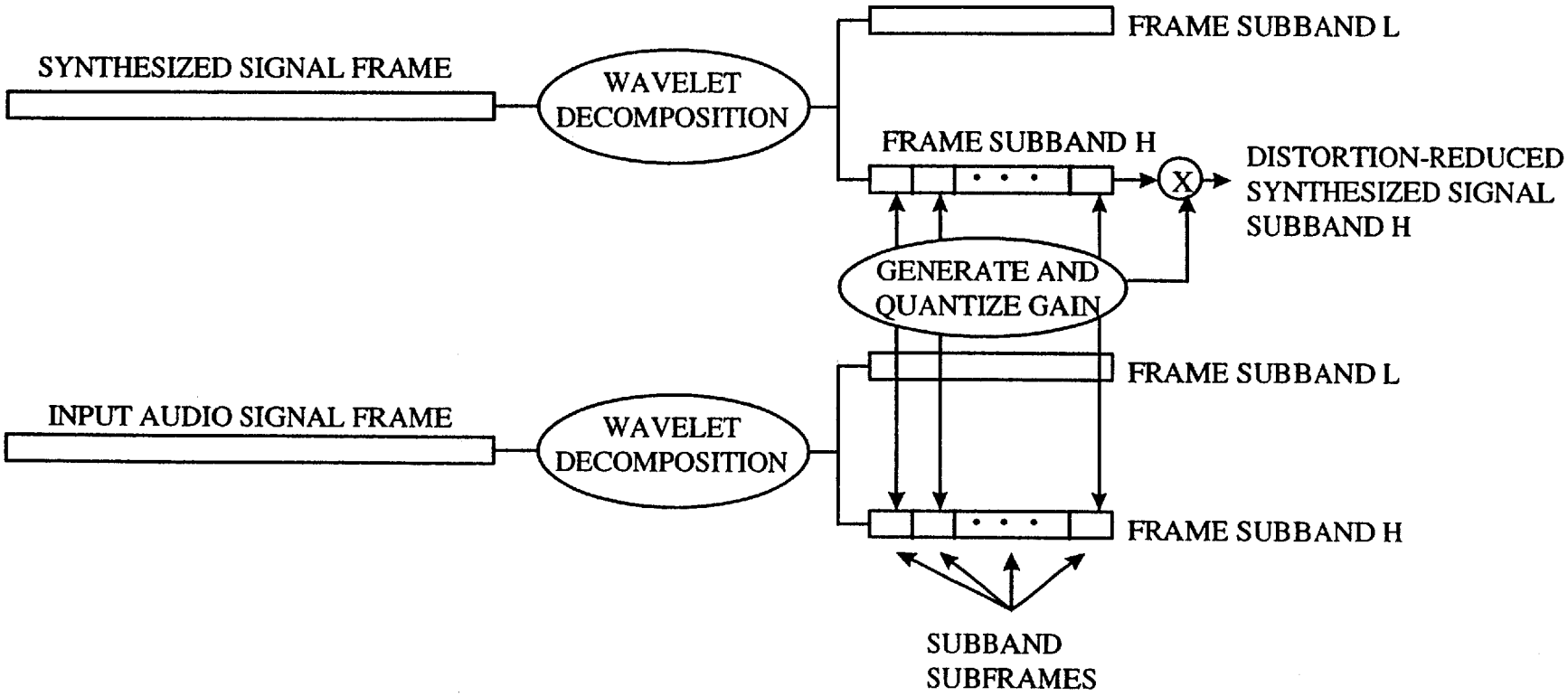
FIG. 10 is a block diagram illustrating an exemplary technique for performing distortion reduction for subband H according to one embodiment of the invention.

At step 902, a subband of the synthesized signal frame and the corresponding subband of the input audio signal frame are divided into corresponding sets of subband subframes, and flow passes to step 904. To provide an example, FIG. 10 is a block diagram illustrating an exemplary technique for performing distortion reduction for subband H according to one embodiment of the invention. FIG. 10 shows the wavelet decomposition of both the synthesized signal frame and input audio signal frame into subbands H and L, each. Although FIG. 10 shows the decomposition of the frames into a low frequency subband L and a high frequency subband H, the frames can be decomposed into additional subbands as previously described. In addition, FIG. 10 also shows the division of subband H of both the synthesized signal and input audio signal into corresponding subband subframes. The length of the subband subframes may be the same or different than that of the subframes described with reference to FIG. 8.

At step 904, a distortion indicator is determined for each pair of corresponding subband subframes and control passes to step 906. In one embodiment, the distortion indicator is the gain that is calculated according to the following equation:

$$g=(x,y)/\|x\|^2$$

where y is a subband subframe of the input audio signal and x is the corresponding subband subframe of the synthesized signal. With reference to FIG. 10, the generation of the gain value for each pair of corresponding subband subframes from subband H is shown.

At step 906, the subband subframes of the synthesized signal having unacceptable distortion are suppressed to generate a distortion-reduced synthesized signal subband. From step 906, control passes to step 602. In the embodiment shown in FIG. 10, the gain values are quantized, and the subband subframes of the synthesized signal subband H are multiplied by the corresponding quantized gain values (also referred to as attenuation coefficients). In a particular implementation of FIG. 10, the quantization scale is 1 and 0, and thus, each of the subband subframes of the synthesized signal subband H are multiplied by a corresponding quantized gain of either one (1) or zero (0) (where a subband subframe with unacceptable distortion has a quantized gain value of 0, thereby effectively suppressing the synthesized signal in that particular subband subframe). Thus, in one embodiment, a binary vector may be generated that identifies which subband subframes were suppressed. For example, the binary vector may contain zero's in bit positions corresponding to subband segments where distortion is unacceptable and one's in bit positions corresponding to subband segments where distortion, if any, was acceptable. The binary vector is included in the set of distortion parameters output with compressed audio data so that an audio decoder can recreate the distortion-reduced synthesized transform encoded signal.

While a specific embodiment in which quantized gain values on a quantization scale of 0 and 1 is described, alternative embodiments can use any number of techniques to suppress subband subframes with distortion. For example, a larger quantization scale can be used. As another example, data in addition to the gain or other than the gain can be used. In addition, while FIG. 9 is a flow diagram illustrating the parallel processing of all of the subband subframes at once, alternative embodiments could iteratively perform the operations of FIG. 9 on subsets of the subband subframes (e.g., one or more, but less than all of the subband subframes) in parallel.

In an alternative embodiment, only those subbands in which distortion is detected are processed as described in FIG. 9. In particular, prior to dividing a subband of the synthesized signal into subband subframes, the wavelet coefficients of the subband of the synthesized signal are compared to the wavelet coefficients of the corresponding subband of the input audio signal. If distortion beyond a threshold is detected as a result of the comparison, then the subband is processed as described in FIG. 9. Otherwise, that synthesized signal subband is provided to step 602 without performing the distortion reduction of step 600.

In summary, the transform coding of the input audio signal can capture harmonic type sound well by using only a selected number of the transform coefficients (in one embodiment, roughly 20%) that contain most of the energy of the signal. However, since non-harmonic type sound is not captured well using transform coding, the synthesized signal generated as a result of the transform coding will contain distortion. To reduce this distortion, the synthesized signal and the input audio signal are subband decomposed. By comparing corresponding subbands (or subband subframes) of the synthesized signal and the input audio signal, those subbands (or subband subframes) of the synthesized signal containing the distortion are located and suppressed to generate distortion-reduced synthesized signal subbands.

Figure 1B:
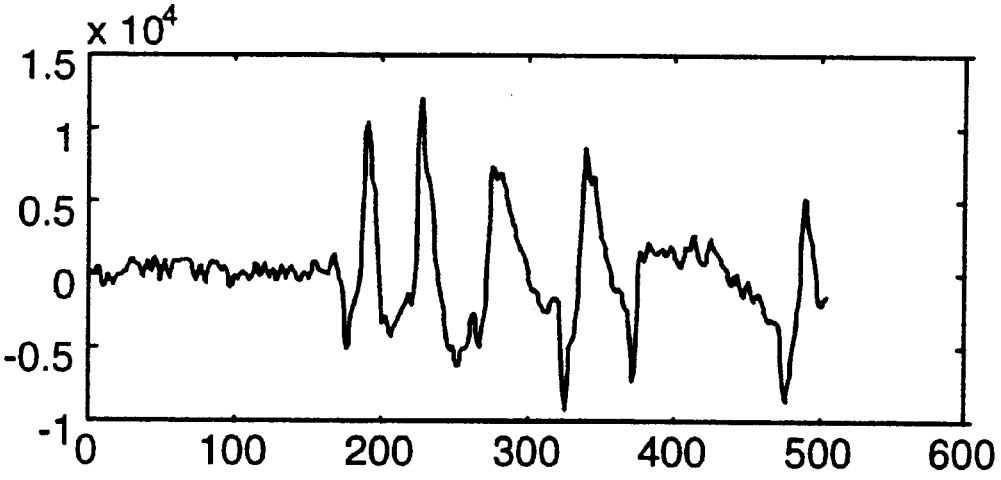
FIG. 1B is a graphical representation of a transform encoded synthesized signal generated by transform encoding and synthesizing the input signal of FIG. 1A.

While one exemplary technique has been described for reducing distortion for a given frame (e.g., dividing into subband subframes, etc.), alternative embodiments can use any number of other techniques. For example, in an alternative embodiment, in addition to or rather than altering subbands of the synthesized signal, certain of subframes of the synthesized signal are suppressed prior to performing the wavelet decomposition. In particular, when performing the distortion detection of step 600, the synthesized signal frame and the input audio frame are broken into subframes. If an amplitude of an nth subframe of the input audio signal is relatively low (e.g., approximately zero), and the SNR for the subframe is a threshold value (e.g., one), then the amplitude of the corresponding nth subframe of the synthesized signal is reduced to substantially the same value (e.g., zero). Referring again to FIGS. 1A and 1B, the described technique may effectively reduce or eliminate the pre-echo (from period 0 to 100) because the pre-echo is easy to detect (the energy of the synthesized signal is larger than the energy of the original signal) and can be corrected by altering the synthesized signal to zero. However, this method will not be effective on the post-echo (from period 300–400) because the post-echo is not easy is detect and cannot be corrected by altering the synthesized signal to zero (both signals have large energies).

In one embodiment, the number of extra bits used for distortion detection and reduction strongly depends on the concrete audio file and on the frame file. The worse case bit allocation in one embodiment of the invention for distortion detection and reduction is shown in the following table:

| | |
|---|---|
| Distortion presence indicator for frame | 1 bit |
| Distortion indicators for subbands | 3 bits |
| Distortion indicators for subband subframes (subframe length = 16) | 512/16 = 32 |
| Attenuation coefficients for subbands | 32*3 = 96 |
| Total number of bits for distortion reduction | 132 |

DECOMPRESSION

As is well known in the art, the type of compression technique used dictates the type of decompression that must be performed. In addition, it is appreciated that since decompression generally performs the inverse of operations performed in compression, for every alternative compression technique described, there is a corresponding decompression technique. As such, while techniques for decompressing a signal compressed using subband decomposition of a residual signal and distortion reduction will be described, it is appreciated that the decompression techniques can be modified to match the various alternative embodiments described with reference to the compression techniques.

Figure 11:
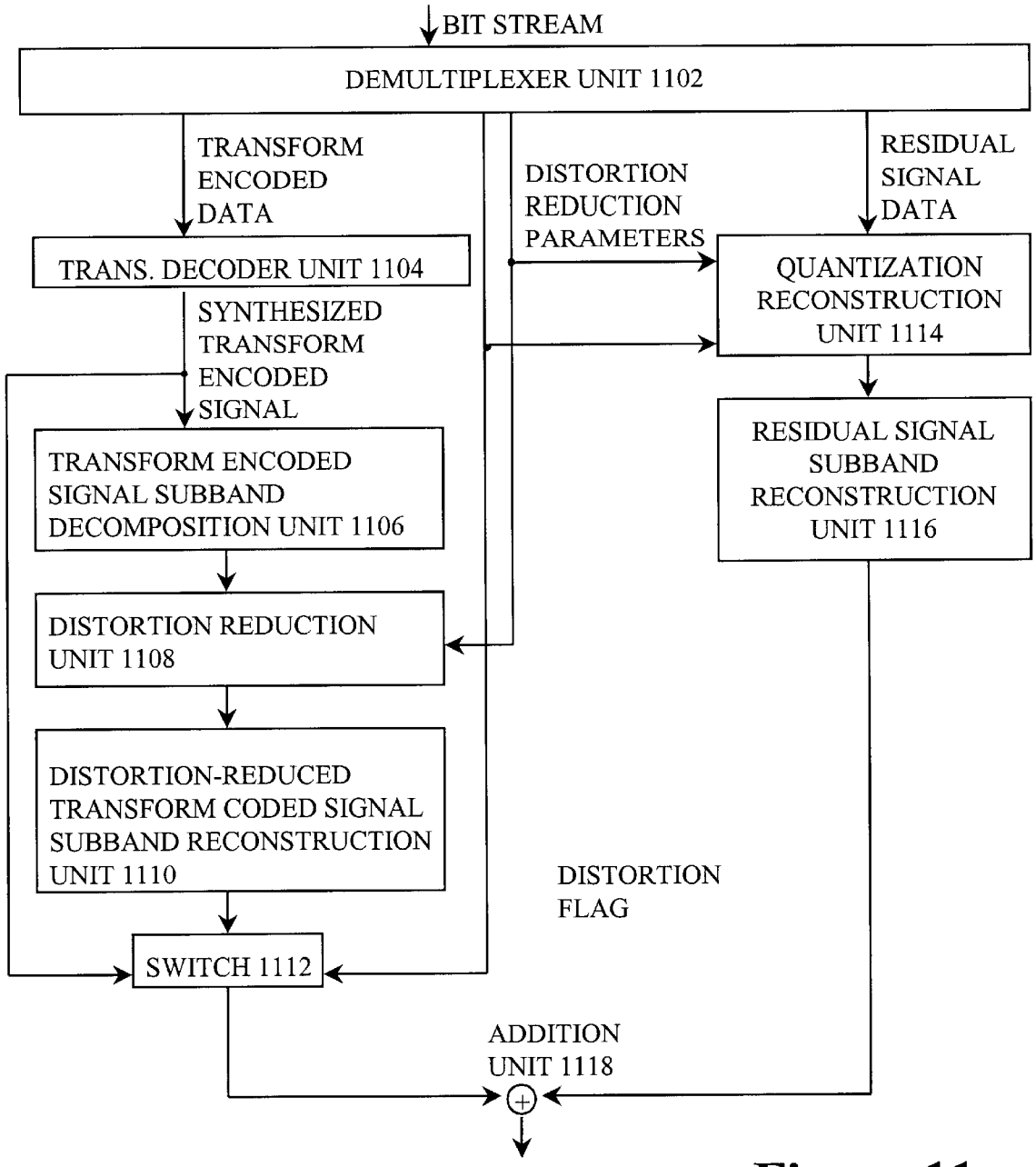
FIG. 11 is a block diagram illustrating an audio decoder for performing audio decompression utilizing subband decomposition of a residual signal and distortion reduction according to one embodiment of the invention.

FIG. 11 is a block diagram illustrating an audio decoder for performing audio decompression utilizing subband decomposition of a residual signal and distortion reduction according to one embodiment of the invention. The audio decoder 1100 operates in two modes, a distortion reduction mode and a non-distortion reduced subband mode, depending on the type of compressed data being received.

The audio decoder 1100 includes a demultiplexer unit 1102 that receives the compressed audio data. The bit stream may be received over one or more types of data communication links (e.g., wireless/RF, computer bus, network interface, etc.) and/or from a storage device/medium. If the bit stream was generated using non-distortion reduced subband compression, the demultiplexer unit 1102 will demultiplex the bit stream into transform encoded data, residual signal data, and a distortion flag that indicates non-distortion reduced subband compression was used. However, if the bit stream was generated using distortion reduced subband compression, the demultiplexer unit 1102 will demultiplex the bit stream into transform encoded data, residual signal data, distortion reduction parameters, and a distortion flag that indicates distortion reduced subband compression was used. The demultiplexer unit 1102 provides the transform encoded data to a transform decoder unit 1104; the residual signal data to a quantization reconstruction unit 1114; the distortion flag to a switch 1112 and the quantization reconstruction unit 1114; and the distortion reduction parameters to a distortion reduction unit 1108 and the quantization reconstruction unit 1114.

The transform decoder unit 1104 reverses the transform encoding of the input audio signal to generate a synthesized transform encoded signal. The synthesized transform encoded signal is provided to a transform encoded subband decomposition unit 1106 and the switch 1112.

The synthesized transform encoded subband decomposition unit 1106 performs the subband decomposition performed during compression and provides the subbands to the distortion reduction unit 1108. As previously described, in one embodiment of the invention the subband coding and decoding is performed according to the described wavelet processing technique.

The distortion reduction unit 1108, responsive to the distortion reduction parameters, performs the distortion reduction that was performed during compression and provides the set distortion-reduced subbands to a distortion-reduced transform coded subband reconstruction unit 1110. For example, in one embodiment the subbands received by the distortion reduction unit 1108 are divided into sets of subband subframes which are then multiplied by the quantized gains identified by the distortion reduction parameters.

The transform coded subband reconstruction unit 1110 reconstructs a distortion-reduced synthesized transform coded signal and provides it to the switch 1112. The switch 1112 is response to the distortion flag to select the appropriate version of the synthesized transform coded signal and provides it to an addition unit 1118.

As previously described, the residual signal data represents the difference between an original/input audio signal and the transform encoded audio data obtained by encoding the input audio signal, which difference has been decomposed into subbands, quantized, and encoded. The quantization reconstruction unit 1114 reverses the encoding and quantization performed during compression and provides the resulting residual signal subbands to a residual signal subband reconstruction unit 1116. For example, in one embodiment the residual signal data includes subband codeword indices and gains. The quantization reconstruction unit 1114 also receives the distortion flag and distortion reduction parameters to properly dequantize the compressed residual signal subbands. In particular, if distortion reduction was used, then the quantization reconstruction unit 1114 generates distortion-reduced residual signal subbands. In one embodiment, one or more of the initial bits of the codeword indices are utilized by the quantization reconstruction unit 1114 to determine a node of a trellis (such as the trellis diagram 500 described above with reference to FIG. 5), while bits following the initial bits indicate a path through the trellis. The quantization reconstruction unit 1114 generates reconstructed subband residual signals, based on the selected code word multiplied by a selected gain corresponding to the gain value.

The residual signal subband reconstruction unit 1116 reconstructs the residual signal (or the distortion-reduced residual signal) and provides it to the addition unit 1118. The addition unit 1118 combines the inputs to generate the output audio signal. It should be understood that various types of filtering, digital-to-analog conversion, modulation, etc. may also be performed to generate the output audio signal.

Figure 12:
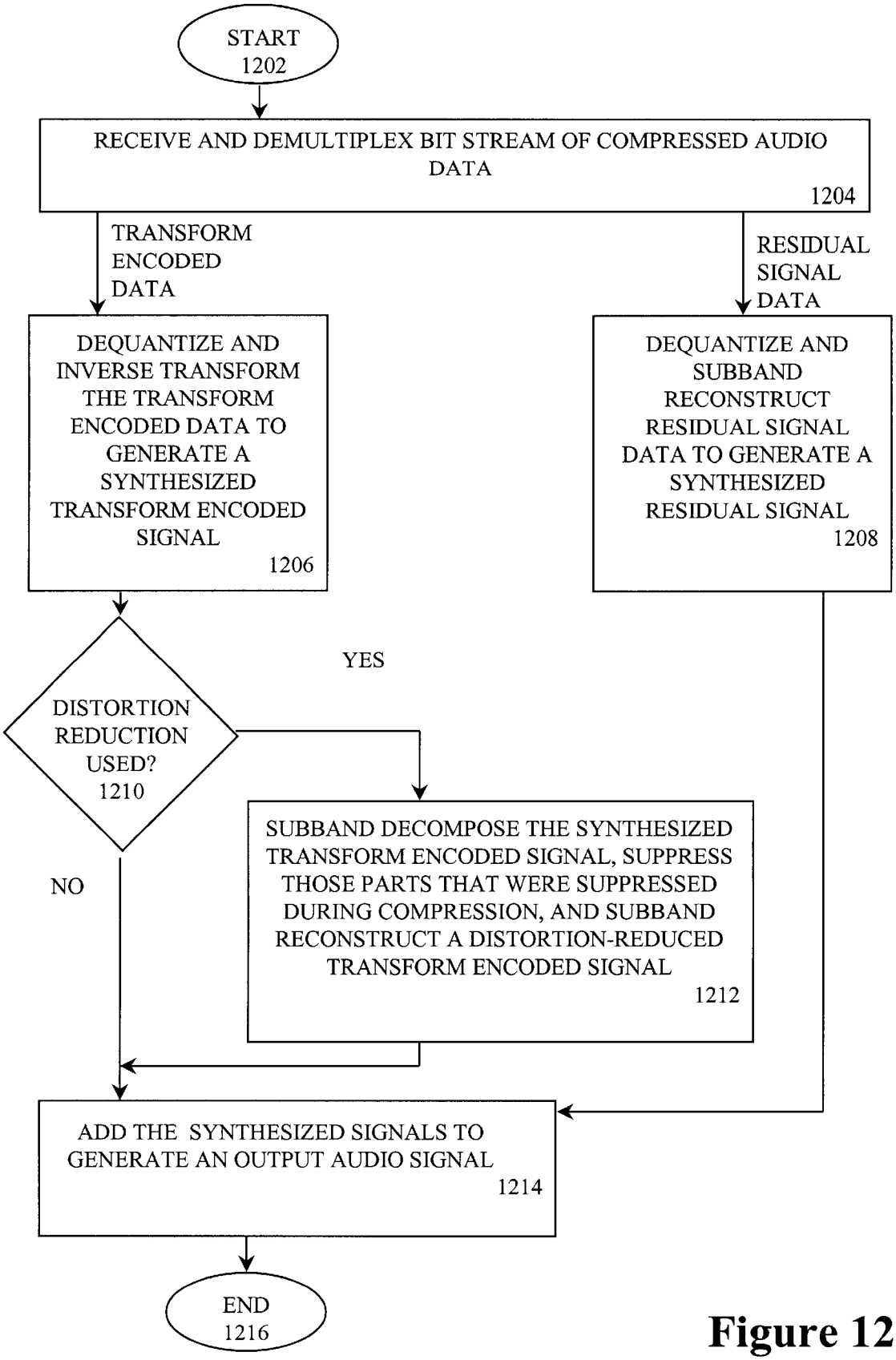
FIG. 12 is a flow diagram illustrating a method for audio decompression utilizing subband decomposition of a residual signal and distortion reduction according to one embodiment of the invention.

FIG. 12 is a flow diagram illustrating a method for audio decompression utilizing subband decomposition of a residual signal and distortion reduction according to one embodiment of the invention. The concept of FIG. 12 is similar in many respects to FIG. 11. In FIG. 12, flow starts at step 1202 and ends at step 1216.

From step 1202, control passes to step 1204 where a bit stream containing compressed audio data is received. In step 1204, the input bit stream is demultiplexed into transform encoded data and residual signal data that is respectively operated on in steps 1206 and 1208. Similar to the demultiplexing of the bit stream described with reference to FIG. 11, the bit stream demultiplexed in step 1204 could have been compressed using distortion reduced subband compression or non-distortion reduced subband compression.

In step 1206, the transform encoded data is dequantized and inverse transformed to generate a synthesized transform encoded signal. From step 1206, control passes to step 1210.

In step 1210, it is determine whether distortion reduced subband compression was used. If distortion reduced subband compression was used, control passes to step 1212. Otherwise, control passes to step 1214. As described with reference to FIG. 11, the determination performed in step 1210 can be made based on data (e.g., a distortion flag) placed in the bit stream.

In step 1212, the synthesized transform encoded signal is subband decomposed; those parts of the resulting subbands that were suppressed during compression are suppressed; and the distortion-reduced subbands are wavelet composed to reconstruct a distortion-reduced transform encoded signal. Thus, steps 1206, 1210, and 1212 decompress the transform encoded data into a synthesized signal, whether it be into the synthesized transform encoded signal or the synthesized distortion-reduced transformed encoded signal.

In step 1208, the residual signal data is decoded, dequantized, and subband reconstructed to generate a synthesized residual signal. As described above with reference to FIG. 11, the steps performed to dequantize the residual signal data may be performed in a slightly different manner depending on whether distortion-reduced subband compression was used. From step 1208, control passes to step 1214.

In step 1214, the provided synthesized signals are added to generate the output audio signal. From step 1214, control passes to step 1216 where the flow diagram ends.

As previously described, since the method of decompression is dictated by the method of compression, there is an alternative decompression embodiment for each alternative compression embodiment. By way of example, an alternative decompression embodiment which did not perform distortion reduction would not include units 1106–1112, the distortion reduction parameters, or the distortion flag.

IMPLEMENTATIONS

The invention can be implemented using any number of combinations of hardware, firmware, and/or software. For example, general purpose, dedicated, DSP, and/or other types of processing circuitry may be employed to perform compression and/or decompression of audio data according to the one or more aspects of the invention as claimed below. By way of a particular example, a card containing dedicated hardware/firmware/software (e.g., the frame buffers(s), transform encoder/decoder unit; wavelet decomposition/composition unit; quantization/dequantization unit, distortion detection and reduction units, etc.) could be connected via a bus in a standard PC configuration. Alternatively, dedicated hardware/firmware/software could be connected to a standard PC configuration via one of the standard ports (e.g., the parallel port). In yet another alternative embodiment, the main memory (including caches) and host processor(s) of a standard computer system could be used to execute code that causes the required operations to be performed. Where software is used to implement all or part of the invention, the sequences of instructions can be stored on a "machine readable medium," such as read only memory (ROM), random access memory (RAM), magnetic disk storage media, optical storage media, flash memory devices, carrier waves received over a network, etc.

By way of example, certain or all of the units in the block diagram of the audio encoder shown in FIG. 7 can be implemented in software to be executed by a general purpose computer. As is well known in the art, if the units of FIG. 7 are implemented in software, the switch of FIG. 7 would typically be implemented in a different manner—based on whether distortion was detected, only the required routines would be called rather than generating both inputs to the switch. Of course, this principle is true for other embodiments described herein. Thus, it is understood by one of ordinary skill in the art that various combinations of hardware, firmware, and/or software can be used to implement the various aspects of the invention.

ALTERNATIVE EMBODIMENTS

While the invention has been described in terms of several embodiments, those skilled in the art will recognize that the invention is not limited to the embodiments described. In particular, the invention can be practiced in several alternative embodiments that provide subband decomposition of a residual signal (which represents the difference between an input audio signal and an encoded and synthesized signal generated from the input audio signal) and/or distortion detection and reduction based on a comparison of the input audio signal with the encoded and synthesized signal.

Thus, while several embodiments have been described using trellis quantization, wavelet decomposition, and transform encoding, it should be understood that alternative embodiments do not necessarily perform trellis quantization, wavelet decomposition, and/or transform encoding. Furthermore, alternative embodiments may use one or more types of criteria to detect distortion (e.g., signal-to-noise ratio, noise-to-signal ratio, frequency separation, etc.) or may not perform distortion/detection reduction.

Therefore, it should be understood that the method and apparatus of the invention can be practiced with modification and alteration within the spirit and scope of the appended claims. The description is thus to be regarded as illustrative instead of limiting on the invention.

What is claimed is:

1. A computer-implemented method for compressing audio data, comprising:

encoding a first frame of an input audio signal to generate a first encoded signal;

generating a first synthesized signal from the first encoded signal;

generating a first residual signal representing a difference between the first frame of the input audio signal and the first synthesized signal;

wavelet decomposing the first residual signal into a first set of residual signal subbands; and encoding at least certain subbands in the first set of residual signal subbands.

2. The method of claim 1, wherein said encoding at least certain subbands in the first set of residual signal subbands includes:

performing a trellis quantization of at least certain subbands in the first set of residual signal subbands.

3. The method of claim 1, wherein said encoding the first frame of the input audio signal to generate the first encoded signal includes:

transform encoding the first frame of the input audio signal to generate a first set of encoded transform coefficients.

4. The method of claim 1, wherein the wavelet decomposing the first residual signal into the first set of residual signal subbands includes:

performing one or more wavelet decompositions.

5. The method of claim 1, further comprising:

encoding a second frame of the input audio signal to generate a second encoded signal;

generating a second synthesized signal from the second encoded signal;

decomposing the second synthesized signal into a second set of subbands;

decomposing the second frame of the input audio signal into a third set of subbands;

comparing at least certain parts of at least certain corresponding subbands in the second and third sets of subbands;

suppressing at least parts of the second set of subbands based on said comparing to generate a modified second set of subbands;

generating a second set of residual signal subbands representing a difference between the third set of subbands and the modified second set of subbands;

encoding at least certain subbands in the second set of residual signal subbands.

6. The method of claim 5, further comprising:

determining that the first synthesized signal is sufficiently similar to the first frame of the input audio signal prior to said step of encoding at least certain subbands in the first set of residual signal subbands; and determining that the second synthesized signal is sufficiently dissimilar to the second frame of the input audio signal prior to said encoding at least certain subbands in the second set of residual signal subbands; and determining to encode the first and second frames of the input audio signal differently based on said determining that the first synthesized signal is sufficiently similar and said determining that the second synthesized signal is sufficiently dissimilar.

7. The method of claim 6, wherein said determining that the second synthesized signal is sufficiently dissimilar includes:

comparing corresponding subframes of the second synthesized signal and the second frame of the input audio signal to detect distortion; and detecting that the distortion is sufficiently high in a sufficiently large number of the subframes.

8. The method of claim 7, wherein said comparing includes:

determining a ratio between signal and noise in the subframes.

9. The method of claim 5, wherein:

said comparing includes comparing corresponding subband subframes of the second and third sets of subbands to detect distortion; and said suppressing at least parts of the second set of subbands based on said comparing to generate the modified second set of subbands includes suppressing those subband subframes in the second set of subbands for which there is a sufficient amount of distortion detected.

10. A machine readable medium having stored thereon sequences of instructions, which when executed by a processor, cause the processor to perform the following:

encoding a first frame of an input audio signal to generate a first encoded signal;

generating a first synthesized signal from the first encoded signal;

generating a first residual signal representing a difference between the first frame of the input audio signal and the first synthesized signal;

wavelet decomposing the first residual signal into a first set of residual signal subbands; and encoding at least certain subbands in the first set of residual signal subbands.

11. The machine readable medium of claim 10, wherein said encoding at least certain subbands in the first set of residual signal subbands includes:

performing a trellis quantization of at least certain of the first set of residual signal subbands.

12. The machine readable medium of claim 10, wherein said encoding the first frame of the input audio signal to generate the first encoded signal includes:

transform encoding the first frame of the input audio signal to generate a first set of encoded transform coefficients.

13. The machine readable medium of claim 10, wherein the wavelet decomposing the first residual signal into the first set of residual signal subbands includes:

performing one or more wavelet decompositions.

14. The machine readable medium of claim 10, further comprising:

encoding a second frame of the input audio signal to generate a second encoded signal;

generating a second synthesized signal from the second encoded signal;

decomposing the second synthesized signal into a second set of subbands;

decomposing the second frame of the input audio signal into a third set of subbands;

comparing at least certain parts of at least certain corresponding subbands in the second and third sets of subbands;

suppressing at least parts of the second set of subbands based on said step of comparing to generate a modified second set of subbands;

generating a second set of residual signal subbands representing a difference between the third set of subbands and the modified second set of subbands;

encoding at least certain subbands in the second set of residual signal subbands.

15. The machine readable medium of claim 14, further comprising:

determining that the first synthesized signal is sufficiently similar to the first frame of the input audio signal prior to said step of encoding at least certain subbands in the first set of residual signal subbands; and determining that the second synthesized signal is sufficiently dissimilar to the second frame of the input audio signal prior to said encoding at least certain subbands in the second set of residual signal subbands; and determining to encode the first and second frames of the input audio signal differently based on said determining that the first synthesized signal is sufficiently similar and said determining that the second synthesized signal is sufficiently dissimilar.

16. The machine readable medium of claim 15, wherein said determining that the second synthesized signal is sufficiently dissimilar includes:

comparing corresponding subframes of the second synthesized signal and the second frame of the input audio signal to detect distortion; and detecting that the distortion is sufficiently high in a sufficiently large number of the subframes.

17. The machine readable medium of claim 16, wherein said comparing includes:

determining a ratio between signal and noise in the subframes.

18. The machine readable medium of claim 14, wherein:

said comparing includes comparing corresponding subband subframes of the second and third sets of subbands to detect distortion; and said suppressing at least parts of the second set of subbands based on said comparing to generate the modified second set of subbands includes suppressing those subband subframes in the second set of subbands for which there is a sufficient amount of distortion detected.

19. An apparatus to compress audio data, comprising:

an encoding unit comprising an input coupled to receive an input audio signal and an output to provide an encoded signal;

a synthesizing unit coupled to the output of the encoding unit;

a first subtraction unit having inputs coupled to the output of the encoding unit and the synthesizing unit to generate a residual signal;

a residual signal wavelet decomposition unit coupled to the output of the subtraction unit to decompose the residual signal into a set of subbands; and an quantization unit coupled to receive at least certain of the set of subbands.

20. The apparatus of claim 19, wherein the encoding unit comprises a transform encoding unit.

21. The apparatus of claim 19, wherein the quantization unit includes a trellis quantization unit to adaptively quantize at least certain of the set of subbands.

22. The apparatus of claim 19, further comprising:

an input audio signal subband decomposition unit coupled to receive the input audio signal;

a synthesized signal subband decomposition unit coupled to the output of the synthesizing unit;

a distortion reduction unit coupled to the output of the input audio signal subband decomposition unit and the synthesized signal subband decomposition unit;

a second subtraction unit having inputs coupled to the output of the distortion reduction unit and the output of the input audio signal subband decomposition unit;

a distortion detection unit coupled to receive the input audio signal and coupled to the output of the synthesizing unit to detect distortion in different frames of the synthesized signal based on comparing corresponding frames of the synthesized signal and the input audio signal, said distortion detection unit to selectively provide the output of either the residual signal subband decomposition unit or the second subtraction unit based on the level of distortion detected.

23. A computer-implemented method of compressing an input audio signal comprising:

encoding a first frame of the input audio signal to generate a first encoded signal;

generating a first synthesized signal from the first encoded signal;

decomposing the first synthesized signal into a first set of subbands;

decomposing the first frame of the input audio signal into a second set of subbands;

comparing at least certain parts of at least certain corresponding subbands in the first and second sets of subbands;

suppressing at least parts of the first set of subbands based on said step of comparing to generate a modified first set of subbands;

generating a first set of residual signal subbands representing a difference between the second set of subbands and the modified first set of subbands;

encoding at least certain of the first set of residual signal subbands.

24. The method of claim 23, wherein said encoding at least certain of the first set of residual subbands includes;

performing a trellis quantization of the first set of residual signal subbands.

25. The method of claim 23, wherein said encoding the first frame of the input audio signal to generate the first encoded signal includes:

transform encoding the first frame of the input audio signal to generate a first set of encoded transform coefficients.

26. The method of claim 23, wherein:

said comparing includes comparing corresponding subband subframes of the first and second sets of subbands to detect distortion; and said suppressing at least parts of the first set of subbands based on said comparing to generate the modified first set of subbands includes suppressing those subband subframes in the first set of subbands for which there is a sufficient amount of distortion detected.

27. The method of claim 23, further comprising:

determining that the first synthesized signal is not sufficiently similar to the first frame of the input audio signal prior to said encoding at least certain of the first set of residual signal subbands.

28. The method of claim 27, wherein said determining that the first synthesized signal is not sufficiently similar includes:

comparing corresponding subframes of the first synthesized signal and the first frame of the input audio signal to detect distortion; and detecting that the distortion is sufficiently high in a sufficiently large number of the subframes.

29. The method of claim 28, wherein said comparing includes:

determining a ratio between signal and noise in the subframes.

30. The method of claim 28, further comprising:

encoding a second frame of an input audio signal to generate a second encoded signal;

generating a second synthesized signal from the second encoded signal;

determining that the second synthesized signal is sufficiently similar to the second frame of the input audio signal;

generating a second residual signal representing a difference between the second frame of the input audio signal and the second synthesized signal;

decomposing the second residual signal into a second set of residual signal subbands; and encoding at least certain of the second set of residual signal subbands.

31. The method of claim 30, wherein said decomposing the second residual signal includes performing one or more wavelet decompositions.

32. The method of claim 23, wherein said acts of decomposing include performing one or more wavelet decompositions.

33. A machine readable medium having stored thereon sequences of instructions, which when executed by a processor, cause the processor to perform the following:

encoding a first frame of an input audio signal to generate a first encoded signal;

generating a first synthesized signal from the first encoded signal;

decomposing the first synthesized signal into a first set of subbands;

decomposing the first frame of the input audio signal into a second set of subbands;

comparing at least certain parts of at least certain corresponding subbands in the first and second sets of subbands;

suppressing at least parts of the first set of subbands based on said step of comparing to generate a modified first set of subbands;

generating a first set of residual signal subbands representing a difference between the second set of subbands and the modified first set of subbands;

encoding at least certain of the first set of residual signal subbands.

34. The machine readable medium of claim 33, wherein said encoding at least certain of the first set of residual signal subbands includes:

performing a trellis quantization of the first set of residual signal subbands.

35. The machine readable medium of claim 33, wherein said encoding the first frame of the input audio signal to generate the first encoded signal includes:

transform encoding the first frame of the input audio signal to generate a first set of encoded transform coefficients.

36. The machine readable medium of claim 33, wherein:

said comparing includes the step of comparing corresponding subband subframes of the first and second sets of subbands to detect distortion; and said suppressing at least parts of the first set of subbands based on said comparing to generate the modified first set of subbands includes suppressing those subband subframes in the first set of subbands for which there is a sufficient amount of distortion detected.

37. The machine readable medium of claim 33, further comprising:

determining that the first synthesized signal is not sufficiently similar to the first frame of the input audio signal prior to said encoding at least certain of the first set of residual signal subbands.

38. The machine readable medium of claim 37, wherein said determining that the first synthesized signal is not sufficiently similar includes:

comparing corresponding subframes of the first synthesized signal and the first frame of the input audio signal to detect distortion; and detecting that the distortion is sufficiently high in a sufficiently large number of the subframes.

39. The machine readable medium of claim 38, wherein said comparing includes:

determining a ratio between signal and noise in the subframes.

40. The machine readable medium of claim 38, further comprising:

encoding a second frame of an input audio signal to generate a second encoded signal;

generating a second synthesized signal from the second encoded signal;

determining that the second synthesized signal is sufficiently similar to the second frame of the input audio signal;

generating a second residual signal representing a difference between the second frame of the input audio signal and the second synthesized signal;

decomposing the second residual signal into a second set of residual signal subbands; and encoding at least certain of the second set of residual signal subbands.

41. The machine readable medium of claim 40, wherein said decomposing the second residual signal includes performing one or more wavelet decompositions.

42. The machine readable medium of claim 33, wherein said acts of decomposing include performing one or more wavelet decompositions.

43. An apparatus to compress audio data comprising:

an encoding unit comprising an input coupled to receive an input audio signal and an output to provide an encoded signal;

a synthesizing unit coupled to the output of the encoding unit;

an input audio signal subband decomposition unit coupled to receive the input audio signal;

a synthesized signal subband decomposition unit coupled to the output of the synthesizing unit;

a distortion reduction unit coupled to the output of the input audio signal subband decomposition unit and the synthesized signal subband decomposition unit;

a first subtraction unit having inputs coupled to the output of the distortion reduction unit and the output of the input audio signal wavelet decomposition unit;

a quantization unit coupled to the output of the first subtraction unit.

44. The apparatus of claim 43, wherein the encoding unit comprises a transform encoding unit.

45. The apparatus of claim 43, wherein the encoding unit includes a trellis quantization unit to adaptively quantize the set of subbands.

46. The apparatus of claim 43, wherein both the input audio signal subband decomposition unit and the synthesized signal subband decomposition unit comprise a set of wavelet filters to decompose signals into at least a high frequency subband and a low frequency subband.

47. The apparatus of claim 46, further comprising:

a second subtraction unit having inputs coupled to the output of the encoding unit and the synthesizing unit to generate a residual signal;

a residual signal subband decomposition unit coupled to the output of the subtraction unit to decompose the residual signal into a set of subbands; and a distortion detection unit coupled to receive the input audio signal and coupled to the output of the synthesizing unit to detect distortion in different frames of the synthesized signal based on comparing corresponding frames of the synthesized signal and the input audio signal, said distortion detection unit to select the output of either the residual signal subband decomposition unit or the first subtraction unit based on the level of distortion detected.

48. A computer-implemented method of decompressing an audio signal that was compressed, said method comprising:

decompressing a first transform encoded frame to generate a first synthesized signal frame;

decompressing residual signal data associated with the first frame to generate a first set of residual signal subbands, the residual signal data representing the difference between the first frame of the original audio signal and the first transform encoded frame;

wavelet reconstructing the first set of residual signal subbands using wavelets to generate a first synthesized residual signal frame; and adding the first synthesized signal frame and the first synthesized residual signal frame to generate a first decoded audio signal frame.

49. The method of claim 48, wherein the decompressing a first transform encoded frame to generate a first synthesized signal frame includes:

dequantizing and inverse transform coding said first transform encoded frame;

subband decomposing the result of said step of dequantizing and inverse transform coding to generate a first set of subbands;

inspecting the input data to determine which parts of the subbands were suppressed during compression of the original audio signal;

suppressing those parts of the first set of subbands; and subband reconstructing the results of said step of suppressing.

50. The method of claim 49, wherein said subband decomposing and said subband reconstructing include respectively performing one or more wavelet decompositions and reconstructions.

51. The method of claim 48 wherein:

said decompressing the first transform encoded frame to generate the first synthesized signal frame includes, dequantizing and inverse transform coding said first transform encoded frame to generate said first synthesized signal frame; and said method further includes, decoding a second transform encoded frame to generate a second synthesized signal frame;

subband decomposing the second synthesized signal frame into a first set of synthesized signal subbands;

suppressing those parts of the first set of synthesized signal subbands that were suppressed during compression;

decoding residual signal data associated with the second frame to generate a second set of residual signal subbands, the residual signal data representing the difference between the second frame of the original audio signal and the second transform encoded frame;

subband reconstructing the second set of residual signal subbands to generate a second synthesized residual signal frame; and adding the second synthesized signal frame and the second synthesized residual signal frame to generate a second decoded audio signal frame.

52. A machine readable medium having stored thereon sequences of instructions, which when executed by a processor, cause the processor to perform the following:

decompressing a first transform encoded frame to generate a first synthesized signal frame;

decompressing residual signal data associated with the first frame to generate a first set of residual signal subbands, the residual signal data representing the difference between the first frame of the original audio signal and the first transform encoded frame;

wavelet reconstructing the first set of residual signal subbands using wavelets to generate a first synthesized residual signal frame; and adding the first synthesized signal frame and the first synthesized residual signal frame to generate a first decoded audio signal frame.

53. The machine readable medium of claim 52, wherein the decompressing a first transform encoded frame to generate a first synthesized signal frame includes:

dequantizing and inverse transform coding said first transform encoded frame;

subband decomposing the result of said dequantizing and inverse transform coding to generate a first set of subbands;

inspecting the input data to determine which parts of the subbands were suppressed during compression of the original audio signal;

suppressing those parts of the first set of subbands; and subband reconstructing the results of said suppressing.

54. The machine readable medium of claim 53, wherein said subband decomposing and said subband reconstructing include respectively performing one or more wavelet decompositions and reconstructions.

55. The machine readable medium of claim 52 wherein:

said decompressing the first transform encoded frame to generate the first synthesized signal frame includes, dequantizing and inverse transform coding said first transform encoded frame to generate said first synthesized signal frame; and said method further includes, decoding a second transform encoded frame to generate a second synthesized signal frame;

subband decomposing the second synthesized signal frame into a first set of synthesized signal subbands;

suppressing those parts of the first set of synthesized signal subbands that were suppressed during compression;

decoding residual signal data associated with the second frame to generate a second set of residual signal subbands, the residual signal data representing the difference between the second frame of the original audio signal and the second transform encoded frame;

subband reconstructing the second set of residual signal subbands to generate a second synthesized residual signal frame; and adding the second synthesized signal frame and the second synthesized residual signal frame to generate a second decoded audio signal frame.

56. A computer-implemented method of decompressing an audio signal that was compressed, said method comprising:

decompressing a first transform encoded frame into a first synthesized signal frame;

subband decomposing the first synthesized signal frame into a first set of synthesized signal subbands;

suppressing those parts of the first set of synthesized signal subbands that were suppressed during compression;

subband reconstructing the results of the suppressing to generate a first distortion-reduced synthesized signal frame;

decompressing residual signal data associated with the first frame to generate a first set of residual signal subbands, the residual signal data representing the difference between the first frame of the original audio signal and the first transform encoded frame;

subband reconstructing the first set of residual signal subbands to generate a first synthesized residual signal frame; and adding the first distortion-reduced synthesized signal frame and the first synthesized residual signal frame to generate a first decompressed audio signal frame.

57. The method of claim 56, wherein said subband decomposing and the subband reconstructing are performed using wavelets.

58. The method of claim 56, wherein said decompressing residual signal data includes:

performing a trellis dequantization.

59. The method of claim 56, further comprising:

decompressing a second transform encoded frame to generate a second synthesized signal frame;

decompressing residual signal data associated with the second frame to generate a second set of residual signal subbands, the residual signal data representing the difference between the second frame of the original audio signal and the second transform encoded frame;

subband reconstructing the second set of residual signal subbands using wavelets to generate a second synthesized residual signal frame; and adding the second synthesized signal frame and the second synthesized residual signal frame to generate a second decompressed audio signal frame.

60. A machine readable medium having stored thereon sequences of instructions, which when executed by a processor, cause the processor to perform the following:

decompressing a first transform encoded frame into a first synthesized signal frame;

subband decomposing the first synthesized signal frame into a first set of synthesized signal subbands;

suppressing those parts of the first set of synthesized signal subbands that were suppressed during compression;

subband reconstructing the results of the step of suppressing to generate a first distortion-reduced synthesized signal frame;

decompressing residual signal data associated with the first frame to generate a first set of residual signal subbands, the residual signal data representing the difference between the first frame of the original audio signal and the first transform encoded frame;

subband reconstructing the first set of residual signal subbands to generate a first synthesized residual signal frame; and adding the first distortion-reduced synthesized signal frame and the first synthesized residual signal frame to generate a first decompressed audio signal frame.

61. The machine readable medium of claim 60, wherein said subband decomposing and the subband reconstructing are performed using wavelets.

62. The machine readable medium of claim 60, wherein said decompressing residual signal data includes:

performing a trellis dequantization.

63. The machine readable medium of claim 60, further comprising:

decompressing a second transform encoded frame to generate a second synthesized signal frame;

decompressing residual signal data associated with the second frame to generate a second set of residual signal subbands, the residual signal data representing the difference between the second frame of the original audio signal and the second transform encoded frame;

subband reconstructing the second set of residual signal subbands using wavelets to generate a second synthesized residual signal frame; and adding the second synthesized signal frame and the second synthesized residual signal frame to generate a second decompressed audio signal frame.

* * * * *